US009885310B2

(12) United States Patent
Pursifull et al.

(10) Patent No.: US 9,885,310 B2
(45) Date of Patent: Feb. 6, 2018

(54) SYSTEM AND METHODS FOR FUEL PRESSURE CONTROL

(71) Applicant: Ford Global Technologies, LLC, Dearborn, MI (US)

(72) Inventors: Ross Dykstra Pursifull, Dearborn, MI (US); Justin Trzeciak, Riverview, MI (US); Joseph Norman Ulrey, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 24 days.

(21) Appl. No.: 15/002,030

(22) Filed: Jan. 20, 2016

(65) Prior Publication Data

US 2017/0204803 A1 Jul. 20, 2017

(51) Int. Cl.
*F02D 41/38* (2006.01)
*F02M 63/02* (2006.01)

(52) U.S. Cl.
CPC ..... *F02D 41/3845* (2013.01); *F02M 63/0265* (2013.01)

(58) Field of Classification Search
CPC ..... F02D 41/3845; F02D 2200/0602; F02D 41/3836; F02D 19/0684; F02D 19/0605; F02M 63/0265; Y10T 10/44
See application file for complete search history.

(56) References Cited

U.S. PATENT DOCUMENTS 5,775,304 A 7/1998 Kono et al.
6,450,147 B2 * 9/2002 Demura ..... F02D 41/1482 123/458
8,776,764 B2 * 7/2014 Basmaji ..... F02D 19/0605 123/27 GE
8,886,441 B2 * 11/2014 Dolker ..... F02D 41/1401 123/198 D
2002/0020397 A1 * 2/2002 Begley ..... F02D 41/3836 123/497
2010/0307454 A1 * 12/2010 Ulrey ..... F02M 21/0224 123/445
2012/0080010 A1 * 4/2012 Nistler ..... F02D 41/3863 123/456
2014/0034022 A1 * 2/2014 Hu ..... F02D 41/3845 123/456

(Continued)

FOREIGN PATENT DOCUMENTS

JP 2867815 B2 3/1999
JP 4165950 B2 10/2008

*Primary Examiner* — Joseph Dallo
*Assistant Examiner* — Kurt Liethen
(74) *Attorney, Agent, or Firm* — Julia Voutyras; McCoy Russell LLP

(57) ABSTRACT

Methods and systems are provided for operating a lift pump of an engine fuel system. In one example, a method may comprise closed loop operating a lift pump of a fuel system based on a difference between a desired fuel rail pressure and an estimated fuel rail pressure, and open loop operating the lift pump to the desired fuel rail pressure in response to a fuel flow rate in a direction of a fuel rail through a check valve positioned between the lift pump and the fuel rail decreasing to a threshold. Thus, outputs from a fuel rail pressure sensor may not be used to adjust lift pump operation when an amount of fuel flowing to the fuel rail decreases to a threshold.

18 Claims, 7 Drawing Sheets

(56) References Cited

U.S. PATENT DOCUMENTS

| | | | | |
|---|---|---|---|---|
| 2015/0159644 | A1* | 6/2015 | Jonas | F02D 41/3836<br>417/44.2 |
| 2016/0025030 | A1* | 1/2016 | Ulrey | F02D 41/3854<br>123/294 |
| 2016/0146146 | A1* | 5/2016 | Pursifull | F02D 41/3854<br>701/104 |

* cited by examiner

SYSTEM AND METHODS FOR FUEL PRESSURE CONTROL

FIELD

The present description relates generally to methods and systems for operating a fuel lift pump.

BACKGROUND/SUMMARY

Engine fuel may be pumped out of a fuel tank by a lift pump. The lift pump propels fuel towards a fuel rail before being injected by fuel injectors. A check valve may be included between the lift pump and the fuel rail to maintain fuel rail pressure and prevent fuel in the fuel rail from flowing back towards the lift pump. Operation of the lift pump is typically feedback controlled by an engine controller based on outputs from a pressure sensor coupled in the fuel rail. The controller attempts to maintain the pressure in the fuel rail to a desired pressure by adjusting an amount of power supplied to the lift pump based on a difference, or error, between the desired fuel pressure and a measured fuel pressure obtained from the pressure sensor.

However, the inventors herein have recognized potential issues with such systems. As one example, when the fuel injectors are turned off, such as during deceleration fuel shut-off (DFSO), power to the lift pump may be reduced. Turning off the fuel injectors may cause fuel rail pressure to increase while the lift pump is on and spinning. Thus, power to the lift pump, and therefore lift pump speed may be reduced in an attempt to reduce fuel rail pressure. However, since fuel is prevented from flowing backwards through the check valve, reducing power to the fuel pump may have no effect on the fuel pressure of fuel included between the check valve and the fuel rail. Further, when fuel injection is commanded back on, it may take time for the fuel pump to spin up. Due to the delay of the fuel pump spin-up time, and/or integrator wind-up of the controller, transient fuel pressure drops may occur when exiting DFSO, leading to fuel metering errors that may degrade engine thermal efficiency and increase regulated emissions.

Further, in examples where the fuel rail pressure is variable, closed loop control of the lift pump may command for a decrease in lift pump voltage when fuel injection is insufficient to lower the fuel rail pressure at a desired rate. However, since decreasing lift pump voltage may have little to no effect on fuel rail pressure, such closed loop control of the lift pump may result in wind-up of the integral term and transient pressure undershoots.

As one example, the issues described above may be addressed by a method comprising closed loop operating a lift pump of a fuel system based on a difference between a desired fuel rail pressure and an estimated fuel rail pressure, and open loop operating the lift pump to the desired fuel rail pressure in response to a fuel flow rate in a direction of a fuel rail through a check valve positioned between the lift pump and the fuel rail decreasing to a threshold.

During the closed loop operating the lift pump, an amount of power supplied to the lift pump may be adjusted based on outputs from a pressure sensor coupled in the fuel rail. Specifically, the closed loop operating the lift pump may comprise adjusting an amount of power supplied to the lift pump based on one or more of a proportional term, integral term, and derivative term. Updating and computing the proportional term and integral term may comprise calculating an error based on a current difference between the desired fuel rail pressure and a most recently estimated fuel rail pressure obtained from the pressure sensor. However, open loop operating the lift pump may comprise adjusting the amount of power supplied to the lift pump based only on the desired fuel rail pressure and not based on outputs from the pressure sensor. Specifically, open loop operating the lift pump may comprise freezing the integral term and clipping the proportional term to non-negative values.

In another example, a method for an engine may comprise adjusting an amount of power supplied to a lift pump of a fuel system based on a difference between a desired fuel rail pressure and an estimated fuel rail pressure of a fuel rail, and regulating the amount of power supplied to the lift pump based on a desired lift pump outlet pressure in response to a fuel flow rate in a direction of the fuel rail through a check valve positioned between the lift pump and the fuel rail decreasing to a threshold.

In yet another example, an engine system may comprise a lift pump, a fuel rail including one or more fuel injectors for injecting liquid fuel, a check valve positioned between the lift pump and the fuel rail, a pressure sensor coupled to the fuel rail, and a controller including non-transitory memory with instruction for: switching from closed loop control of the lift pump to open loop control in response to a fuel flow rate through the check valve decreasing to a threshold, and resuming closed loop control of the lift pump in response to the fuel flow rate through the check valve increasing above the threshold.

In this way, transient pressure drops in the fuel rail may be reduced. Specifically, by open loop operating the lift pump during DFSO, lift pump speed may be maintained at a higher level than it would be under closed loop control during DFSO. As such, lift pump spin-up time when exiting DFSO may be reduced, and pressure drops in the fuel rail may be reduced. Thus, fluctuations in fuel rail pressure may be reduced and fuel rail pressure consistency may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
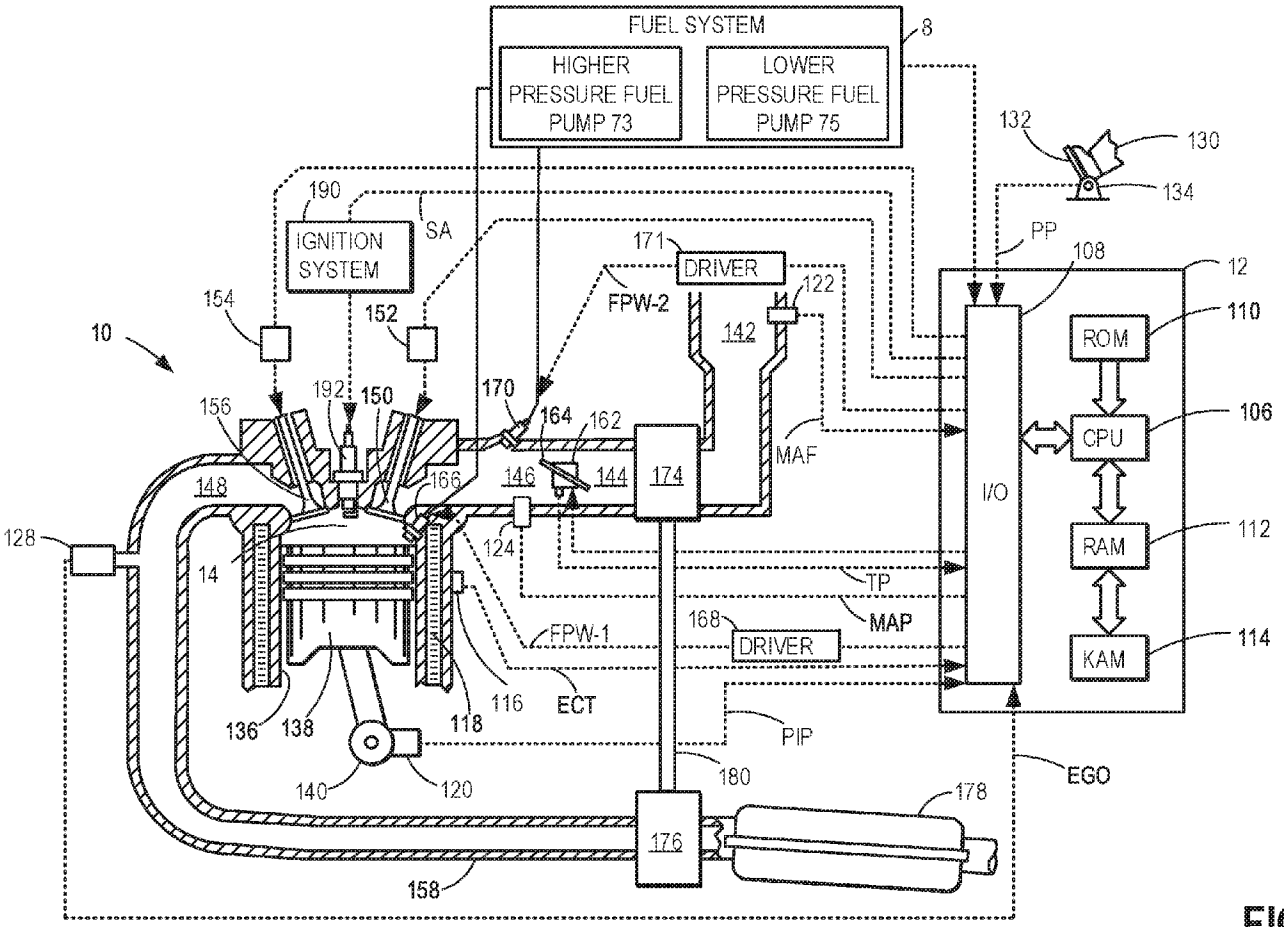
FIG. 1 shows a schematic diagram of an example engine system including a fuel system that may comprise one or more of direct injection and port injection.

The following description relates to systems and methods for operating a lift pump. The lift pump may be included in a fuel system of an engine system, such as the engine system shown in FIG. 1. As shown in the example fuel system of FIG. 2, the lift pump pumps fuel from a fuel tank where the fuel is stored, to a fuel rail where the fuel is injected by fuel injectors. In some examples, the fuel system may be a direct injection (DI) system and fuel may be injected directly into one or more engine cylinders from a direct injection fuel rail. In such examples, a direct injection pump may be positioned between the lift pump and the direct injection fuel rail to further pressurize the fuel prior to injection into the one or more engine cylinders. However, in other examples, the fuel system may be a port fuel injection (PFI) system, and fuel may be injected into an intake port, upstream of the engine cylinders, by a port injection fuel rail. In such examples, fuel may be supplied directly to the port injection fuel rail by the lift pump. In still further examples, the fuel system may include both port fuel injection and direct injection, and as such may be referred to as port fuel direct injection (PFDI). Operation of the lift pump may be feedback controlled by an engine controller based on a fuel pressure at the fuel rail provided by a fuel rail pressure sensor, as is shown in the example fuel control system of FIG. 3. Thus, power supplied to the lift pump may be adjusted to maintain a desired fuel rail pressure.

The volume of fuel in the fuel rail, and thus the fuel rail pressure, may be determined by an amount of fuel entering the fuel rail, an amount of fuel leaving the fuel rail via one or more fuel injectors, and a temperature of the fuel. Thus, the fuel rail pressure may increase with increasing lift pump speeds, and therefore increased fuel flow rates into the fuel rail. Further, the fuel rail pressure may increase with decreasing fuel injection rates, and increasing fuel temperatures of fuel included in the fuel rail. In some examples, fuel temperature may increase at a higher rates when injection flow rates are lower or near zero. When the fuel injection rate is high, and the fuel rail pressure is greater than desired, a reduction in applied lift pump power may result in the desired fuel rail pressure drop.

However, when fuel injection is minimal and/or off, such as during deceleration fuel shut-off (DFSO), reducing power to the lift pump may be ineffective in decreasing fuel rail pressure. That is, in order for the fuel rail pressure to decrease, the rate at which fuel exits the rail via the injectors may need to exceed the rate at which fuel enters the fuel rail from the lift pump. When the injectors are off however, the rate at which fuel exits the fuel rail via the injectors may be approximately zero. Thus, in order for the fuel rail pressure to decrease, fuel flow in the fuel system must reverse direction and flow from the fuel rail to the fuel pump. However, since the fuel system may include a check valve that prevents the flow of fuel from the fuel rail to the fuel pump, no amount of power reduction to the fuel pump may bring about a reduction in fuel rail pressure when the fuel injectors are off. When exiting DFSO, and an increase in fuel rail pressure is desired, there may be a delay to deliver the desired increase in fuel rail pressure. For example, it may take time for the lift pump to spin up to a speed sufficient to deliver the desired pressure. Integrator wind-up of the engine controller may further exacerbate the delay.

Thus, closed loop feedback control of the lift pump during DFSO may lead to pressure drops at the fuel rail under certain engine operating conditions, such as when exiting DFSO. As such, the lift pump may not be feedback controlled and may instead be open loop controlled under certain engine operating conditions, such as when the rate at which fuel exits the fuel rail decreases below a threshold, as shown in the example routine of FIG. 4. FIG. 5 shows example closed loop and open loop lift pump operation under varying engine operating conditions. By open loop operating the lift pump when fuel injection is minimal and/or off, such as during deceleration fuel shut-off (DFSO), the lift pump speed may be maintained at a higher level than it would otherwise be adjusted to during closed loop feedback control. In this way, lift pump spin-up time may be reduced, and pressure drops in the fuel rail when exiting DFSO may be reduced. Thus, fluctuations in fuel rail pressure may be reduced and fuel rail pressure consistency may be increased.

Figure 6:
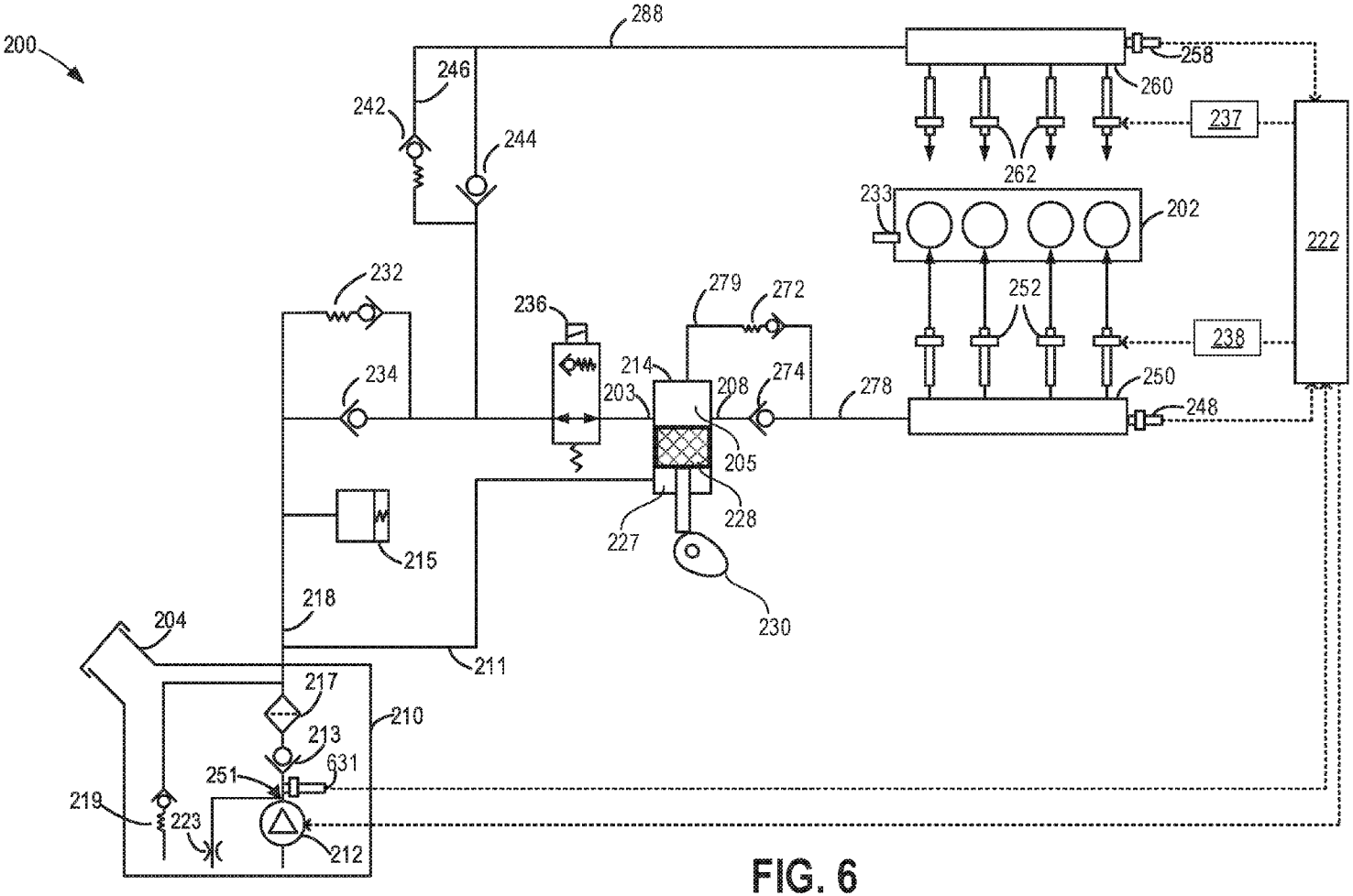
FIG. 6 shows a block diagram of a second example embodiment of a fuel system that may be included in the engine system of FIG. 1.

In other examples, where the fuel system includes a second pressure sensor near an outlet of the lift pump, such as in the example fuel system shown in FIG. 6, the lift pump may be feedback controlled based on outputs from the second pressure instead of being open loop controlled. Thus, the lift pump may be closed loop feedback controlled based on outputs from the fuel rail pressure sensor when fuel injection is on, since the fuel rail pressure sensor may provide a more accurate estimate of the actual fuel rail pressure than the second pressure sensor. Then, under certain engine operating conditions, such as when the fuel flow rate from the lift pump to the fuel rail decreases below a threshold, the lift pump may switch to being feedback controlled based on outputs from the second pressure sensor as shown in the example routine of FIG. 7.

Thus, in examples where the second pressure sensor is included in the fuel system, the lift pump may be continuously feedback controlled, and may not engage and/or enter into open loop control. In such examples, the operation of the lift pump may be adjusted based on outputs from the second pressure sensor. A pressure drop between the first and second pressure sensors may be learned based on outputs from the first and second pressure sensors, and this learned pressure drop may be used to correct lift pump operation.

Regarding terminology used throughout this detailed description, the higher pressure pump, or direct injection fuel pump, may be abbreviated as a HP pump (alternatively, HPP) or a DI fuel pump respectively. As such, DI fuel pump may also be termed DI pump. Accordingly, HPP and DI fuel pump may be used interchangeably to refer to the higher pressure direct injection fuel pump. Similarly, the lift pump may also be referred to as a lower pressure pump. Further, the lower pressure pump may be abbreviated as LP pump or LPP. Port fuel injection may be abbreviated as PFI while direct injection may be abbreviated as DI. Additionally, fuel systems including both port fuel injection and direct injection may be referred to herein as port fuel direct injection and may be abbreviated as PFDI. Also, fuel rail pressure, or the value of pressure of fuel within a fuel rail may be abbreviated as FRP. A direct injection fuel rail may also be referred to as a higher pressure fuel rail, which may be abbreviated as HP fuel rail. Further, a port fuel injection rail may also be referred as a lower pressure fuel rail, which may be abbreviated as LP fuel rail.

It will be appreciated that in the example port fuel direct injection (PFDI) systems shown in the present disclosure, the direct injectors or the port injectors may be deleted without departing from the scope of this disclosure.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (herein also termed combustion chamber 14) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system (not shown). Further, a starter motor (not shown) may be coupled to crankshaft 140 via a flywheel (not shown) to enable a starting operation of engine 10.

Cylinder 14 can receive intake air via a series of intake air passages 142, 144, and 146. Intake air passages 142, 144, and 146 can communicate with other cylinders of engine 10 in addition to cylinder 14. In some examples, one or more of the intake air passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 158. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine.

A throttle 162 including a throttle plate 164 may be arranged between intake air passages 144 and 146 of the engine for varying the flow rate and/or pressure of intake air provided to the engine cylinders. As shown in FIG. 1, throttle 162 may be positioned downstream of compressor 174, or alternatively may be provided upstream of compressor 174.

Exhaust manifold 148 can receive exhaust gases from other cylinders of engine 10 in addition to cylinder 14. Exhaust gas sensor 128 is shown coupled to exhaust passage 158 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom dead center position or top dead center position. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including first fuel injector 166. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into cylinder 14. Thus, first fuel injector 166, may also be referred to herein as DI fuel injector 166. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a higher pressure fuel pump 73, and a fuel rail. Further, the fuel tank may have a pressure transducer providing a signal to controller 12.

Additionally or alternatively, engine 10 may include second fuel injector 170. Fuel injector 166 and 170 may be configured to deliver fuel received from fuel system 8. Specifically, fuel may be delivered to fuel injector 170 from a fuel tank of fuel system 8 via a lower pressure fuel pump 75, and a fuel rail. As elaborated later in the detailed description, fuel system 8 may include one or more fuel tanks, fuel pumps, and fuel rails.

Fuel system 8 may include one fuel tank or multiple fuel tanks. In embodiments where fuel system 8 includes multiple fuel tanks, the fuel tanks may hold fuel with the same fuel qualities or may hold fuel with different fuel qualities, such as different fuel compositions. These differences may include different alcohol content, different octane, different heat of vaporizations, different fuel blends, and/or combinations thereof etc. In one example, fuels with different alcohol contents could include gasoline, ethanol, methanol, or alcohol blends such as E85 (which is approximately 85% ethanol and 15% gasoline) or M85 (which is approximately 85% methanol and 15% gasoline). Other alcohol containing fuels could be a mixture of alcohol and water, a mixture of alcohol, water and gasoline etc. In some examples, fuel system 8 may include a fuel tank holding a liquid fuel, such as gasoline, and also include a fuel tank holding a gaseous fuel, such as CNG.

Fuel injectors 166 and 170 may be configured to inject fuel from the same fuel tank, from different fuel tanks, from a plurality of the same fuel tanks, or from an overlapping set of fuel tanks. Fuel system 8 may include the lower pressure fuel pump 75 (such as a lift pump) and a higher pressure fuel pump 73. The lower pressure fuel pump 75 may be a lift pump that pumps fuel out of the one or more fuel tanks towards the one or more injectors 166 and 170. As detailed below with reference to the fuel system of FIG. 2, fuel provided to the first fuel injector 166 may be further pressurized by higher pressure fuel pump 73. Thus, the lower pressure fuel pump 75 may provide fuel directly to one or more of a port injection fuel rail and the higher pressure fuel pump 73, while higher pressure fuel pump 73 may deliver fuel to a direct injection fuel rail.

Fuel injector 170 is shown arranged in intake air passage 146, rather than in cylinder 14, in a configuration that provides what is known as port injection of fuel into the intake port upstream of cylinder 14. Second fuel injector 170 may inject fuel, received from fuel system 8, in proportion to the pulse width of signal FPW-2 received from controller 12 via electronic driver 171. Note that a single electronic driver 168 or 171 may be used for both fuel injection systems, or multiple drivers, for example electronic driver 168 for fuel injector 166 and electronic driver 171 for optional fuel injector 170, may be used, as depicted.

In an alternate example, each of fuel injectors 166 and 170 may be configured as direct fuel injectors for injecting fuel directly into cylinder 14. In another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. In still another example, cylinder 14 may be fueled solely by optional fuel injector 170, or solely by port injection (also termed, intake manifold injection). As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among fuel injectors 170 and 166, different effects may be achieved.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor 124 may be used to provide an indication of vacuum, or pressure, in the intake manifold.

The controller 12 receives signals from the various sensors of FIG. 1 and employs the various actuators of FIG. 1 (e.g., throttle 162, fuel injector 166, fuel injector 170, higher pressure fuel pump 73, lower pressure fuel pump 75 etc.) to adjust engine operation based on the received signals and instructions stored on a memory of the controller. Specifically, the controller 12 may adjusting operation of the lower pressure fuel pump 75 based on a desired fuel injection amount and/or a pressure of a fuel rail as described in greater detail below with reference to FIG. 2.

Figure 2:
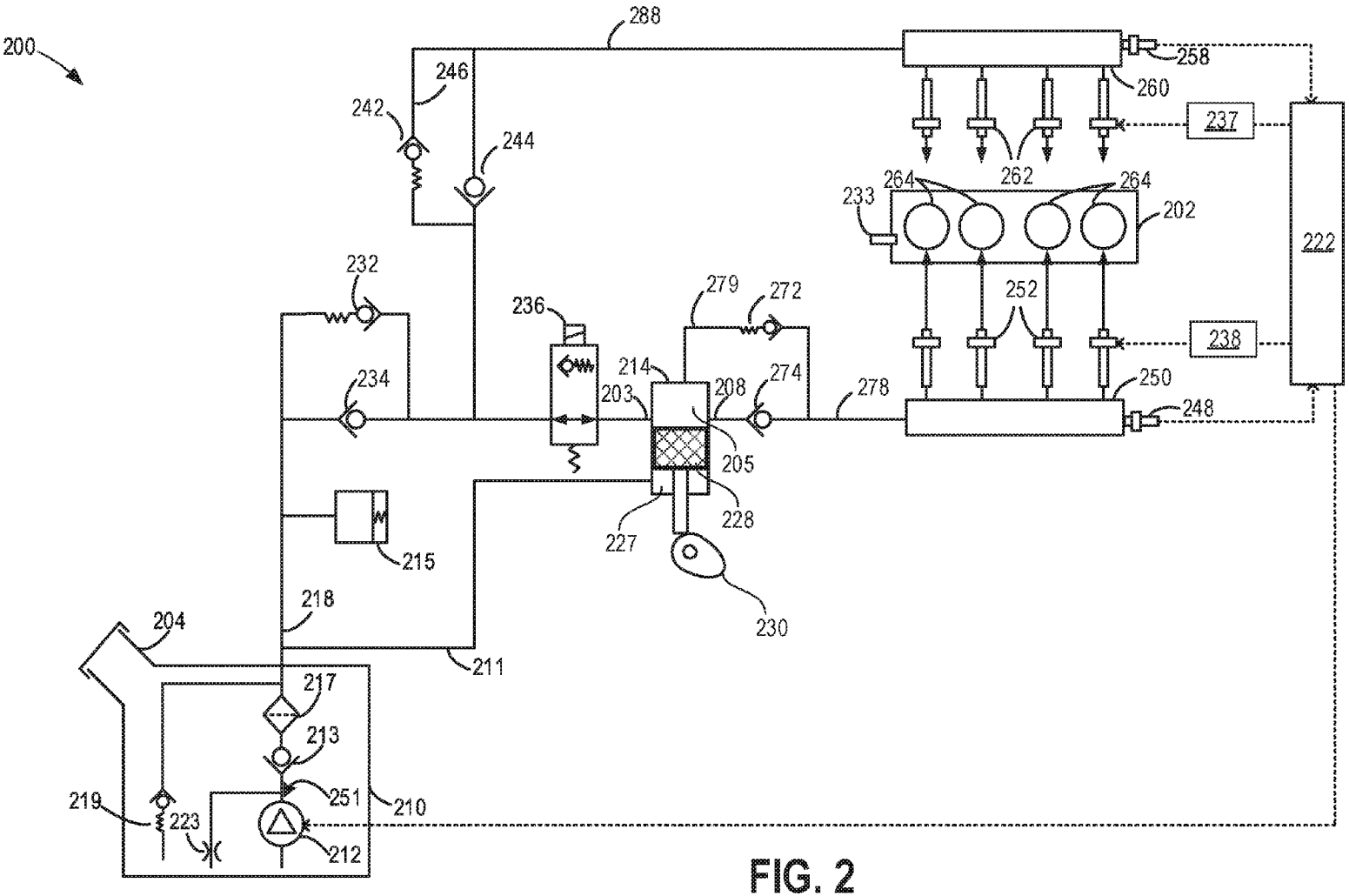
FIG. 2 shows a block diagram of a first example embodiment of a fuel system that may be included in the engine system of FIG. 1.

FIG. 2 schematically depicts an example embodiment of a fuel system 200, which may be the same or similar to fuel system 8 of FIG. 1. Thus, fuel system 200 may be operated to deliver fuel to an engine, such as engine 10 of FIG. 1. Fuel system 200 may be operated by a controller 222, which may be the same or similar to controller 12 described above with reference to FIG. 1, to perform some or all of the operations described below with reference to the flow charts of FIGS. 4 and 7.

Fuel system 200 includes a fuel tank 210, a lift pump 212, a check valve 213, one or more fuel rails, a low pressure passage 218 providing fluidic communication between the pump 212 and the one or more fuel rails, fuel injectors, one or more fuel rail pressure sensors, and engine block 202. Lift pump 212 may also be referred to herein as lower pressure pump (LPP) 212.

As depicted in the example of FIG. 2, the fuel system 200 may be configured as a port fuel direction injection (PFDI) system that includes both a direct injection (DI) fuel rail 250, and a port fuel injection (PFI) fuel rail 260. Lift pump 212 may be operated by the controller 222 to pump fuel from the fuel tank 210 towards one or more of the DI fuel rail 250 and PFI fuel rail 260 via the low pressure passage 218. Check valve 213 may be positioned in the low pressure passage 218, more proximate the fuel pump 212 than the fuel rails 250 and 260, to facilitate fuel delivery and maintain fuel line pressure in passage 218. Specifically, in some examples, check valve 213 may be included in the fuel tank 210. The check valve 213 may be included proximate an outlet 251 of the lift pump 212. As such, flow in the low pressure passage 218 may be unidirectional from the lift pump 212 towards the fuel rails 250 and 260. Said another way, the check valve 213 may prevent bidirectional fuel flow in passage 218 since fuel does not flow backwards through the check valve 213 towards the lift pump 212 and away from the fuel rails 250 and 260. Thus, fuel may only flow away from the lift pump 212 towards one or more of the fuel rails 250 and 260 in the fuel system 200. In the description of fuel system 200 herein, upstream flow therefore refers to fuel flow traveling from fuel rails 250, 260 towards LPP 212 while downstream flow refers to the nominal fuel flow direction from the LPP towards the HPP 214 and thereon to the fuel rails.

After being pumped out of the fuel tank 210 by the lift pump 212, fuel may flow along passage 218 to either the DI fuel rail 250, or the PFI fuel rail 260. Thus, passage 218 may branch into DI supply line 278 and port injection supply line 288, where DI supply line 278 provides fluidic communication with the DI fuel rail 250 and port injection supply line 288 provides fluidic communication with the PFI fuel rail 260. Before reaching the DI fuel rail 250 via the low pressure passage 218, fuel may be further pressurized by a DI pump 214. DI pump 214 may also be referred to in the description herein as higher pressure pump (HPP) 214. Pump 214 may increase the pressure of the fuel prior to direct injection into one or more engine cylinders 264 by direct injectors 252. Thus, fuel pressurized by DI pump 214, may flow through DI supply line 278 to the DI fuel rail 250, where it may await direct injection to the engine cylinders 264 via the direct injectors 252. Direct injectors 252 may be the same or similar to fuel injector 166 described above with reference to FIG. 1. Further, direct injectors 252 may also be referred to in the description herein as direct injectors 252. DI fuel rail 250 may include a first fuel rail pressure sensor 248 for providing an indication of the fuel pressure in the fuel rail 250. Thus, controller 222 may estimate and/or determine the fuel rail pressure (FRP) of the DI fuel rail 250 based on outputs received from the first fuel rail pressure sensor 248.

In some examples, fuel flowing to the PFI fuel rail 260 may not be further pressurized after being pumped out of the fuel tank 210 by the lift pump 212. However, in other examples, fuel flowing to the PFI fuel rail 260 may be further pressurized by DI pump 214 before reaching the PFI fuel rail 260. Thus, fuel may flow from the lift pump 212 to the PFI fuel rail 260, prior to injection into an intake port, upstream of the engine cylinders 264 via port injectors 262. Specifically, fuel may flow through the low pressure passage 218, and then on to port injection supply line 288 before reaching the PFI fuel rail 260. Port injectors 262 may be the same or similar to injector 170 described above with reference to FIG. 1. Further, port injectors 262 may also be referred to in the description herein as port injectors 262. PFI fuel rail 260 may include a second fuel rail pressure sensor 258 for providing an indication of the fuel pressure in the fuel rail 260. Thus, controller 222 may estimate and/or determine the FRP of the PFI fuel rail 260 based on outputs received from the second fuel rail pressure sensor 258.

Although depicted as a PFDI system in FIG. 2, it should be appreciated that fuel system 200 may also be configured as a DI system, or as a PFI system. When configured as a DI system, fuel system 200 may not include PFI fuel rail 260, port injectors 262, pressure sensor 258, and port injection supply line 288. Thus, in examples where the fuel system 200 is configured as a DI fuel system, substantially all fuel pumped from the fuel tank 210 by the lift pump 212 may flow to the DI pump 214, en route to the DI fuel rail 250. As such, the DI fuel rail 250 may receive approximately all of the fuel pumped from the fuel tank 210 by the lift pump 212.

Further, it should also be appreciated that in examples where the fuel system 200 is configured as a PFI system, DI pump 214, DI supply line 278, DI fuel rail 250, pressure sensor 248, and direct injectors 252 may not be included in the fuel system 200. Thus, in examples where the fuel system 200 is configures as a PFI system, substantially all fuel pumped from the fuel tank 210 by the lift pump 212 may flow to the PFI fuel rail 260. As such the PFI fuel rail 260 may receive approximately all of the fuel pumped from the fuel tank 210 by the lift pump 212.

Continuing with the description of the fuel system 200, fuel tank 210 stores the fuel on-board the vehicle. Fuel may be provided to fuel tank 210 via fuel filling passage 204. LPP 212 may be disposed at least partially within the fuel tank 210, and may be an electrically-powered fuel pump. LPP 212 may be operated by controller 222 (e.g., controller 12 of FIG. 1) to provide fuel to HPP 214 via low pressure passage 218. As one example, LPP 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller 222 may send signals to the lift pump 212, and/or to a power supply of the lift pump 212, to reduce the electrical power that is provided to lift pump 212. By reducing the electrical power provided to the lift pump 212, the volumetric flow rate and/or pressure increase across the lift pump may be reduced. Conversely, the volumetric flow rate and/or pressure increase across the lift pump may be increased by increasing electrical power provided to the lift pump 212.

As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, the flow rate and pressure of the fuel provided at the inlet of the higher pressure fuel pump 214 is adjusted.

A filter 217 may be disposed downstream of the lift pump 212, and may remove small impurities contained in the fuel that could potentially damage fuel handling components. In some examples, the filter 217 may be positioned downstream of the check valve 213. However, in other examples, filter 217 may be positioned upstream of the check valve 213, between the fuel pump 212 and the check valve 213. Furthermore, a pressure relief valve 219 may be employed to limit the fuel pressure in low pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be set to anywhere between 6.4 bar and 5 bar (g). An orifice 223 may be utilized to allow for air and/or fuel vapor to bleed out of the lift pump 212. This bleed at orifice 223 may also be used to power a jet pump used to transfer fuel from one location to another within the tank 210. In one example, an orifice check valve (not shown) may be placed in series with orifice 223. In some embodiments, fuel system 200 may include one or more (e.g., a series) of check valves fluidly coupled to low-pressure fuel pump 212 to impede fuel from leaking back upstream of the valves.

Fuel lifted by LPP 212 may be supplied at a lower pressure into low pressure passage 218. From low pressure passage 218, fuel may flow to an inlet 203 of HPP 214. More specifically, in the example depicted in FIG. 2, supply line 288 may be coupled on a first end to downstream of check valve 234, proximate or at an outlet 203 of the DI pump 214, and on a second end to the PFI fuel rail 260 to provide fluidic communication there-between. As such, substantially all fuel pumped out of the tank 210 by the lift pump 212 may be further pressurized by HPP 214 before reaching either of the fuel rails 250 and 260. In such examples, HPP 214 may be operated to raise the pressure of fuel delivered to each of the fuel rails 250 and 260 above the lift pump pressure, where the DI fuel rail 250 coupled to the direct injectors 252 may operate with a variable high pressure while the PFI fuel rail 260 coupled to the port injectors 262, may operate with a fixed high pressure. Thus, high-pressure fuel pump 214 may be in communication with each of fuel rail 260 and fuel rail 250. As a result, high pressure port and direct injection may be enabled.

In such examples, supply line 288 may include valves 244 and 242. Valves 244 and 242 may work in conjunction to keep the PFI fuel rail 260 pressurized to a threshold pressure (e.g., 15 bar) during the compression stroke of piston 228 of DI pump 214. Pressure relief valve 242 may limit the pressure that can build in fuel rail 260 due to thermal expansion of fuel. In some examples, the pressure relief valve 242 may open and allow fuel to flow upstream from the fuel rail 260 towards the passage 218, when the pressure between the valve 242 and the PFI fuel rail 260 increases above a threshold (e.g., 15 bar).

Alternatively, fuel may flow directly from low pressure passage 218 to PFI fuel rail 260 without passing through and/or being pressurized by DI pump 214. In such examples, supply line 288 may be coupled directly to low pressure passage 218, upstream of check valve 234. That is, the supply line 288 may be coupled on one end to upstream of the check valve 234 and downstream of the check valve 213, and on the opposite end to the PFI fuel rail 260, for providing fluidic communication there-between. Thus, no additional pumping and/or pressurization of the fuel may occur between lift pump 212 and the PFI fuel rail 260. Thus, in some examples, DI pump 214 may only be in communication with DI fuel rail 250 and may only pressurize fuel supplied to the DI pump 214. Thus, although the PFI fuel rail 260 is depicted in FIG. 2, to be coupled to downstream of check valve 234 via supply line 288, the supply line 288 may alternatively be coupled to upstream of the check valve 234.

As such, PFI fuel rail 260 may be supplied fuel at a lower pressure than the DI fuel rail 250. Specifically, PFI fuel rail 260 may be supplied with fuel at a pressure approximately the same as the fuel pressure at an outlet of the lift pump 212.

The pressure of each of the fuel rails 250 and 260, may depend on the mass fuel flow rate into the rails 250 and 260 via supply lines 218 and 288, respectively, and the mass fuel flow rates out of the rails 250 and 260 via the injectors 248 and 258, respectively. For example, the fuel rail pressures may increase when the mass flow rate into the fuel rail is greater than the mass flow rate out of the fuel rail. Similarly, the pressure may decrease when the mass flow rate out of the fuel rail is greater than the mass flow rate in to the fuel rail. Thus, when the injectors are off, and fuel is not exiting the fuel rail, the fuel rail pressure may increase while the lift pump 212 is on and spinning, so long as the pressure at the outlet of the fuel pump is greater than the pressure in the fuel rail, and the fuel pump 212 is therefore pushing fuel into the fuel rail.

While each of the DI fuel rail 250 and PFI fuel rail 260 are shown dispensing fuel to four fuel injectors of the respective injectors 252, 262, it will be appreciated that each fuel rail 250 and 260 may dispense fuel to any suitable number of fuel injectors. As one example, DI fuel rail 250 may dispense fuel to one fuel injector of first injectors 252 for each cylinder of the engine while PFI fuel rail 260 may dispense fuel to one fuel injector of second injectors 262 for each cylinder of the engine. Controller 222 can individually actuate each of the port injectors 262 via a port injection driver 237 and actuate each of the direct injectors 252 via a direct injection driver 238. The controller 222, drivers 237 and 238, and other suitable engine system controllers can comprise a control system. While the drivers 237, 238 are shown external to the controller 222, it should be appreciated that in other examples, the controller 222 can include the drivers 237, 238 or can be configured to provide the functionality of the drivers 237, 238. Controller 222 may include additional components not shown, such as those included in controller 12 of FIG. 1.

Controller 222 may be a proportional integral (PI) or proportional integral derivative (PID) controller. As described above, controller 22 may receive an indication of fuel rail pressure via one or more of the first and second fuel rail pressure sensors 248 and 258. More specifically, the controller 222 may estimate the fuel rail pressure in one or more of the DI fuel rail 250 based on outputs from the first fuel rail pressure sensor 248 and in the PFI fuel rail 260 based on outputs from the second fuel rail pressure sensor 258. Based on a difference between a desired fuel rail pressure, and the actual measured fuel rail pressure provided by the one or more of the pressure sensors 248 and 258, the controller 222, may calculate an error. Thus, the error may represent the current difference between the desired fuel rail pressure and the fuel rail pressure estimated based on outputs from the one or more pressure sensors 248 and 258. The error may be multiplied by a proportional gain factor ($K_p$) to obtain a proportional term. Further, the sum of the error over a duration may be multiplied by an integral gain factor ($K_i$) to obtain an integral term. In examples, where the controller 222 is configured as a PID controller, the controller may further calculate a derivative term based on the rate of change of the error and a derivative gain factor ($K_d$).

One or more of the proportional term, integral term, and derivative term may then be incorporated into an output signal (e.g., voltage) sent from the controller 222 to pump 212 and/or a power source providing power to the pump 212, to adjust an amount of power supplied to the pump 212. Specifically, a voltage and/or current supplied to the pump 212 may be adjusted by the controller 222 to match the fuel rail pressure to the desired fuel rail pressure based on one or more of the proportional, integral, and derivative terms. A driver (not shown) electronically coupled to controller 222 may be used to send a control signal to the lift pump 212, as required, to adjust the output (e.g., speed) of the lift pump 212. Thus, based on a difference between the estimated fuel rail pressure obtained from one or more of the pressure sensors 248 and 258 and the desired fuel rail pressure, the controller 222 may adjust an amount of electrical power supplied to the pump 212, to match the actual fuel rail pressure more closely to the desired fuel rail pressure. Generally, the controller 222 may therefore increase power supply to the pump 212 when the fuel rail pressure is less than desired, and may decrease power supply to the pump 212 when the fuel rail pressure is greater than desired. This control scheme, where the controller 222 adjusts its output based on input received from one or more of the pressure sensors 248 and 258 may be referred to herein as closed loop, or feedback control. However, in some examples, as described below with reference to FIG. 4, the controller 222 may operate open loop under certain engine operating conditions.

During open loop control, the controller 222 may not adjust its output and/or the electrical power supplied to the pump 212 based on signals received from one or more of the pressure sensors 248 and 258. Thus, during open loop control, the controller 222 may adjust operation of pump 212 based on the desired fuel rail pressure only. Specifically, the controller 222 may stop updating or freeze the integral term during open loop control. Thus, the controller 222 may not calculate an integral term during open loop control. Additionally or alternatively, the controller 222 may prevent the proportional term from decreasing below a threshold. In some examples, the threshold may be zero. However, in other examples, the threshold may be greater or less than zero. Said another way, the controller 222 may clip the proportional term to only positive values. As such, the proportional term may be set to the threshold (e.g., zero) whenever the proportional term drops below the threshold. In still further examples, the controller 222 may additionally stop updating and/or freeze the proportional term during open loop control. Thus, the controller 222 may in some examples, not calculate a proportional term during open loop control.

HPP 214 may be an engine-driven, positive-displacement pump. As one non-limiting example, HPP 214 may be a BOSCH HDP5 HIGH PRESSURE PUMP. The HPP 214 may utilize a solenoid activated control valve (e.g., fuel volume regulator, magnetic solenoid valve, etc.) 236 to vary the effective pump volume of each pump stroke. The outlet check valve of HPP is mechanically controlled and not electronically controlled by an external controller. HPP 214 may be mechanically driven by the engine in contrast to the motor driven LPP 212. HPP 214 includes a pump piston 228, a pump compression chamber 205 (herein also referred to as compression chamber), and a step-room 227. Pump piston 228 receives a mechanical input from the engine crank shaft or cam shaft via cam 230, thereby operating the HPP according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222.

Continuing with the description of fuel system 200, it may optionally further include accumulator 215. When included, accumulator 215 may be positioned downstream of lower pressure fuel pump 212 and upstream of higher pressure fuel pump 214, and may be configured to hold a volume of fuel that reduces the rate of fuel pressure increase or decrease between fuel pumps 212 and 214. For example, accumulator 215 may be coupled in low pressure passage 218, as shown, or in a bypass passage 211 coupling low pressure passage 218 to the step-room 227 of HPP 214. The volume of accumulator 215 may be sized such that the engine can operate at idle conditions for a predetermined period of time between operating intervals of lower pressure fuel pump 212. For example, accumulator 215 can be sized such that when the engine idles, it takes one or more minutes to deplete pressure in the accumulator to a level at which higher pressure fuel pump 214 is incapable of maintaining a sufficiently high fuel pressure for fuel injectors 252, 262. Accumulator 215 may thus enable an intermittent operation mode (or pulsed mode) of lower pressure fuel pump 212. By reducing the frequency of LPP operation, power consumption may be reduced. In other embodiments, accumulator 215 may inherently exist in the compliance of fuel filter 217 and low pressure passage 218, and thus may not exist as a distinct element. Alternatively, the accumulator may be sized to be the approximate size of the pump displacement. In other words, as fluid is expelled upstream from chambers 227 or 205, the fluid may collect in accumulator 215 while minimizing the pressure change in lines 218, 211, and/or 203.

An engine speed sensor 233 can be used to provide an indication of engine speed to the controller 222. The indication of engine speed can be used to identify the speed of higher pressure fuel pump 214, since the pump 214 may be mechanically driven by the engine 202, for example, via the crankshaft or camshaft.

DI fuel rail 250 is coupled to an outlet 208 of HPP 214 along DI supply line 278. In comparison, PFI fuel rail 260 may be coupled to the inlet 203 of HPP 214 via port injection supply line 288 in examples, where the HPP 214 is configured to pressurize fuel supplied to the PFI fuel rail 260. In other examples, PFI fuel rail 260 may not be coupled to the inlet 203 of the HPP 214 and may instead be coupled directly to the passage 218, upstream of check valve 234. A check valve 274 and/or a pressure relief valve 272 may be positioned between the outlet 208 of the HPP 214 and the DI fuel rail 250. Pressure relief valve 272 may be arranged parallel to check valve 274 in bypass passage 279 and may limit the pressure in DI supply line 278, located downstream of HPP 214 and upstream of DI fuel rail 250. For example, pressure relief valve 272 may limit the pressure in DI supply line 278 to an upper threshold pressure (e.g., 200 bar). As such, pressure relief valve 272 may limit the pressure that would otherwise be generated in DI supply line 278 if control valve 236 were (intentionally or unintentionally) open and while high pressure fuel pump 214 were pumping.

One or more check valves and pressure relief valves may also be coupled to low pressure passage 218, downstream of LPP 212 and upstream of HPP 214. For example, check valve 234 may be provided in low pressure passage 218 to reduce or prevent back-flow of fuel from high pressure pump 214 to low pressure pump 212 and fuel tank 210. In addition, pressure relief valve 232 may be provided in a bypass passage, positioned parallel to check valve 234. Pressure relief valve 232 may limit the pressure downstream of the check valve 234 to a threshold amount (e.g., 10 bar) higher than the pressure upstream of the check valve 234. Said another way, pressure relief valve 232 may allow fuel flow upstream, around the check valve 234, and towards LPP 212 when pressure the pressure increase across the relief valve 232 is greater than the threshold (e.g., 10 bar).

Controller 222 may be configured to regulate fuel flow into HPP 214 through control valve 236 by energizing or de-energizing the control valve 236 (based on the solenoid valve configuration) in synchronism with the driving cam. Accordingly, the solenoid activated control valve 236 may be operated in a first mode where the valve 236 is positioned within HPP inlet 203 to limit (e.g., inhibit) the amount of fuel traveling through the solenoid activated control valve 236. Depending on the timing of the solenoid valve actuation, the volume transferred to the fuel rail 250 may be varied. The control valve 236 may also be operated in a second mode where the solenoid activated control valve 236 is effectively disabled and fuel can travel upstream and downstream of the valve, and in and out of HPP 214.

As such, solenoid activated control valve 236 may be configured to regulate the mass (or volume) of fuel compressed into the DI pump 214. In one example, controller 222 may adjust a closing timing of the solenoid pressure control check valve to regulate the mass of fuel compressed. For example, a late pressure control valve closing may reduce the amount of fuel mass ingested into compression chamber 205. The solenoid activated check valve opening and closing timings may be coordinated with respect to stroke timings of the direct injection fuel pump.

Piston 228 may reciprocate up and down. HPP 214 is in a compression stroke when piston 228 is traveling in a direction that reduces the volume of compression chamber 205. HPP 214 is in a suction stroke when piston 228 is traveling in a direction that increases the volume of compression chamber 205.

Controller 222 may also control the operation of DI pump 214 to adjust an amount, pressure, flow rate, etc., of a fuel delivered to the DI fuel rail 250. As one example, controller 222 can vary a pressure setting, a pump stroke amount, a pump duty cycle command, and/or fuel flow rate of the fuel pumps to deliver fuel to different locations of the fuel system. A driver (not shown) electronically coupled to controller 222 may be used to send a control signal to the low pressure pump, as required, to adjust the output (e.g., speed) of the low pressure pump. In some examples, the solenoid valve may be configured such that high pressure fuel pump 214 delivers fuel only to DI fuel rail 250, and in such a configuration, PFI fuel rail 260 may be supplied fuel at the lower outlet pressure of lift pump 212.

Controller 222 may control the operation of each of the injectors 252 and 262. For example, controller 222 may control the distribution and/or relative amount of fuel delivered from each injector, which may vary with operating conditions, such as engine load, knock, and exhaust temperature. Specifically, controller 222 may adjust a direct injection fuel ratio by sending appropriate signals to port fuel injection driver 237 and direct injection 238, which may in turn actuate the respective port fuel injectors 262 and direct injectors 252 with desired pulse-widths for achieving the desired injection ratios. Additionally, controller 222 may selectively enable and disable (i.e., activate or deactivate) one or more of the injectors 252 and 262 based on fuel pressure within each rail. An example control scheme of the controller 222 is shown below with reference to FIG. 3.

Figure 3:
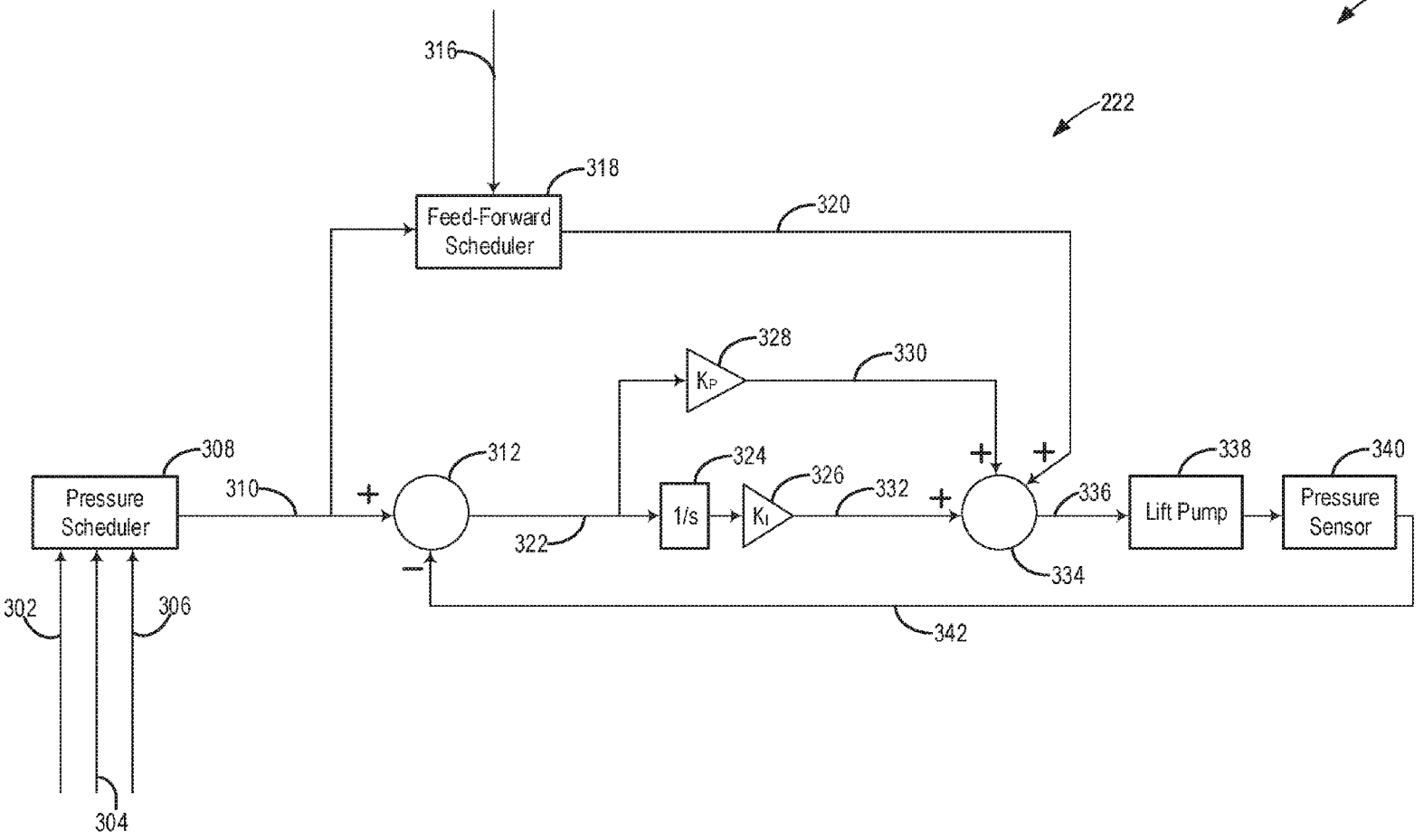
FIG. 3 shows a schematic diagram of an example control system that may be used by a controller of the fuel system of FIG. 2.

Turning now to FIG. 3, it shows an example PID control scheme 300 that may be implemented by a controller (e.g., controller 222 shown in FIG. 2 and controller 12 shown in FIG. 1) to regulate fuel rail pressure in a fuel system (e.g., fuel system 200 shown in FIG. 2). Thus, the control scheme 300 shown in FIG. 3, may be used and/or may be incorporated into the controller 222 shown in FIG. 2, to regulate fuel pressure in one or more of a PFI fuel rail (e.g., PFI fuel rail 260 shown in FIG. 2), and a DI fuel rail (e.g., DI fuel rail 250 shown in FIG. 2). It should be appreciated that in the description herein, a signal may refer to an electrical signal such as an electric current, and that modification of a signal may refer to a change in voltage of the electric current.

A pressure scheduler 308 may first determine a desired fuel rail pressure, which may be a desired pressure of the PFI fuel rail and/or a desired pressure of the DI fuel rail, based on one or more of an intake manifold pressure, fuel injection rate, fuel volatility 302, engine speed 304, and fuel temperature 306. Thus, as inputs, the pressure scheduler 308 may receive a first signal 302 corresponding to a fuel volatility, a second signal corresponding to engine speed 304, and a third signal 306 corresponding to fuel temperature. However, the pressure scheduler 308 may determine the desired fuel rail pressure based on additional engine operating conditions such as a position of an engine throttle (e.g., throttle 162 shown in FIG. 1), engine load, alternator torque, exhaust pressure, speed of a turbocharger (e.g., compressor 174 shown in FIG. 1), intake temperature, intake pressure, etc. The pressure scheduler may determine the desired fuel rail pressure based on the received signals and send a fourth signal 310 corresponding to the desired fuel rail pressure to one or more of a subtractor 312 and a feed-forward scheduler 318. Fuel rail pressure may be an absolute pressure, gauge pressure, or a differential pressure between rail and intake manifold pressure.

The feed-forward scheduler 318 may receive as an input, a fifth signal 316 corresponding to an injector flow rate. Based on the injector flow rate received via the fifth signal 316, the feed-forward scheduler 318 may modify the desired fuel rail pressure to a corrected desired fuel rail pressure, and send a sixth signal 320, to a summer 334. Thus, the feed-forward scheduler 318, may correct the desired fuel rail pressure based on the injector flow rate, and may send a fifth signal 316 to the summer 334, where the fifth signal 316 may represent the corrected desired fuel rail pressure.

The subtractor 312 may receive as inputs the desired fuel rail pressure, and an estimate of the actual fuel rail pressure from a pressure sensor 340 via a sixth signal 342 sent from the pressure sensor 340 to the subtractor 312. Thus, the subtractor 312 may determine an estimate of the actual fuel rail pressure based on outputs received from the pressure sensor 340. Pressure sensor 340 may be the same or similar to pressure sensors 248 and 258 shown in FIG. 2. The subtractor 312 may compute a difference between the desired fuel rail pressure received via the fourth signal 310, and the estimated fuel rail pressure received from the sixth signal 342. Based on the difference, the subtractor 312 may compute an error, represented by seventh signal 322 in FIG. 2. In some examples, the error may be approximately the same as the difference between the desired fuel rail pressure and the estimated fuel rail pressure. Thus, the seventh signal 322, corresponding to the error, may be generated by the subtractor 312. The seventh signal 322 may be processed and/or modified separately by a proportional gain ($K_p$) 328 and by both of an integrator 324 and integral gain ($K_i$) 326.

Thus, the seventh signals 322 be modified by a proportional gain ($K_p$) 328 to generate a proportional term sent as input to the summer 334 via eighth signal 330. Further, the seventh signal 322 corresponding to the error may be integrated by an integrator block 324 in parallel with the modification by the proportional gain ($K_p$). The integrated error signal may then be modified by an integral gain ($K_i$) 326 to generate an integral term. Thus, the seventh signal 322 may be processed separately by the integrator block 324 and proportional gain ($K_p$). Said another way, an eighth signal 330 representing the proportional term and a ninth signal 332 corresponding to the integral term may be used as inputs for the summer 334.

In total, the summer 334 may receive the proportional term via signal (e.g., voltage) 330, integral term via signal 332, and feed-forward term via the fifth signal 320. Based on the received signals, the summer 334 may output a voltage or tenth signal 336 to a lift pump 338 (e.g., lift pump 212 shown in FIG. 2). The tenth signal 336 may be sent to the lift pump 338 to adjust lift pump operation. Specifically, the tenth signal may correspond to a power to be supplied to the lift pump 338. In this way, power supplied to the pump 338 may be adjusted based on changes in the tenth signal 336. However, it is important to note that one or more of a voltage, current, duty cycle, and/or speed or torque command supplied to the pump 338 may be adjusted based on changes in the tenth signal 336.

During closed loop, or feedback control, the pressure sensor may continue to monitor the pressure in the fuel rail and send an estimate of the fuel rail pressure to the subtractor 312. As such, the proportional and integral terms may be affected by the output from the pressure sensor 340, since the error calculated by the subtractor 312 may fluctuate as the estimated fuel rail pressure changes. Thus, during closed loop or feedback control, the output or tenth signal 336 generated by summer 334 may be modified and/or affected by the output from the pressure sensor 340. In this way power supplied to the lift pump 338 may be adjusted based on outputs from the pressure sensor 340.

However, as described in greater detail below with reference to FIG. 4, the controller may periodically switch to open loop control of the lift pump 338. During open loop control, the output 336 generated by the summer 334, and therefore the power supplied to the lift pump 338 may not be adjusted based on outputs from the pressure sensor 340. Specifically, in some example the integral term may be frozen and/or not updated. As such, a most recent integral term obtained during closed loop control may continue to be used as input to the summer 334. However, in other examples, the tenth signal 336 output by the summer 334 may not be modified and/or adjusted based on the signal 332 corresponding to the integral term. More simply, the integral term may not be used as input by the summer 334, and the output signal 336 to the lift pump 338 may be unaffected by the integral term. Thus, signal 332 may not be used to modify and/or adjust the signal 336 output by the summer 334. In yet further examples, the summing block 334 may generate output 336 based only on input 320 received from feed-forward scheduler 318. Additionally or alternatively, the proportional term may be clipped to zero during open loop control. Thus, during open loop control the proportional term may not drop below zero. Any values for the proportional term that are below zero may therefore be set to zero. However, in other examples, the signal 330 corresponding to the proportional term may not be used to modify and/or adjust the signal 336 output by the summer 334. Thus, the summing block 334 may not use the signal 330 as input when generating the signal 336.

Figure 4:
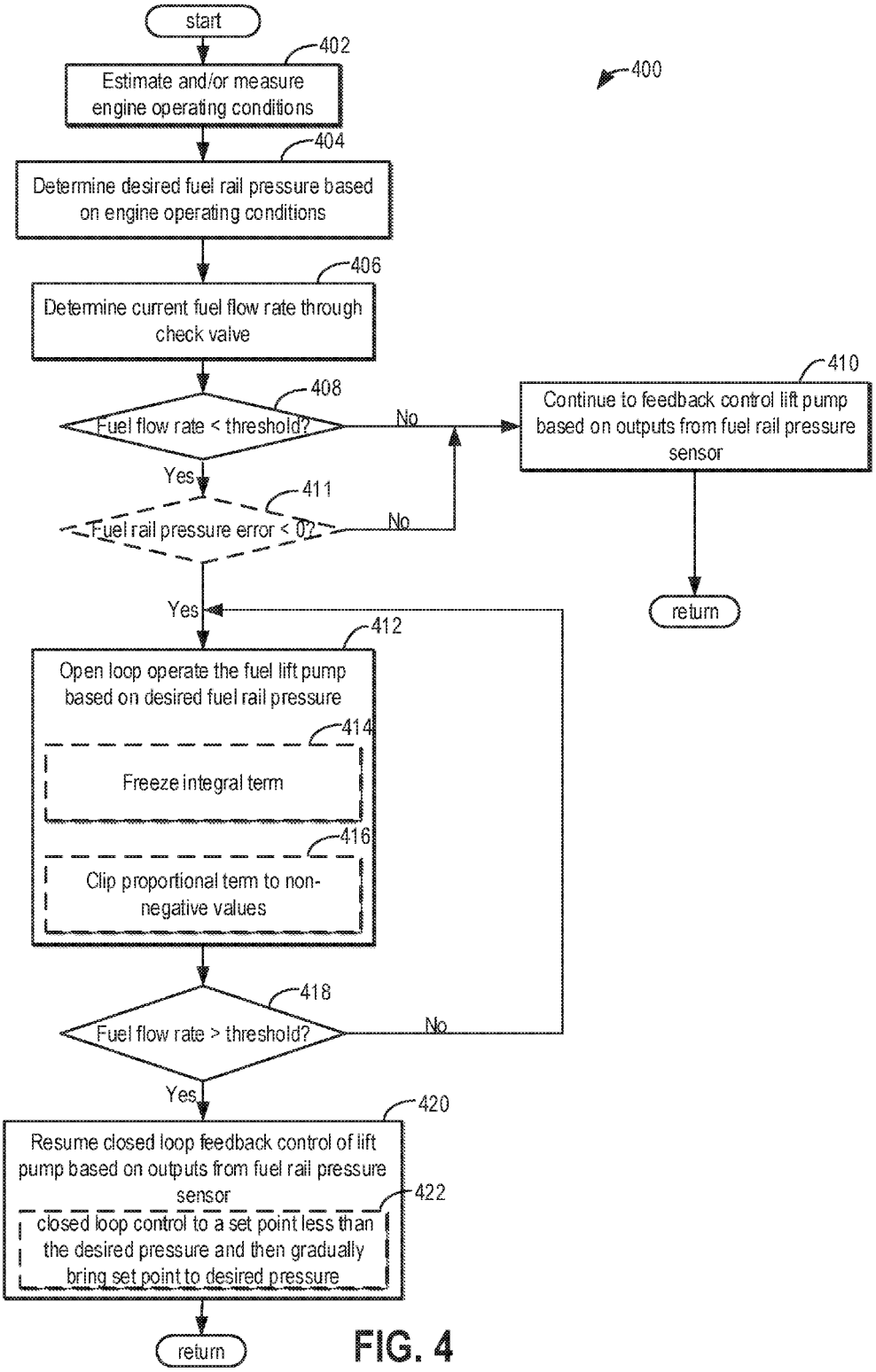
FIG. 4 shows a flow chart of a first example routine for operating a fuel lift pump of the fuel system of FIG. 2.
Figure 5:
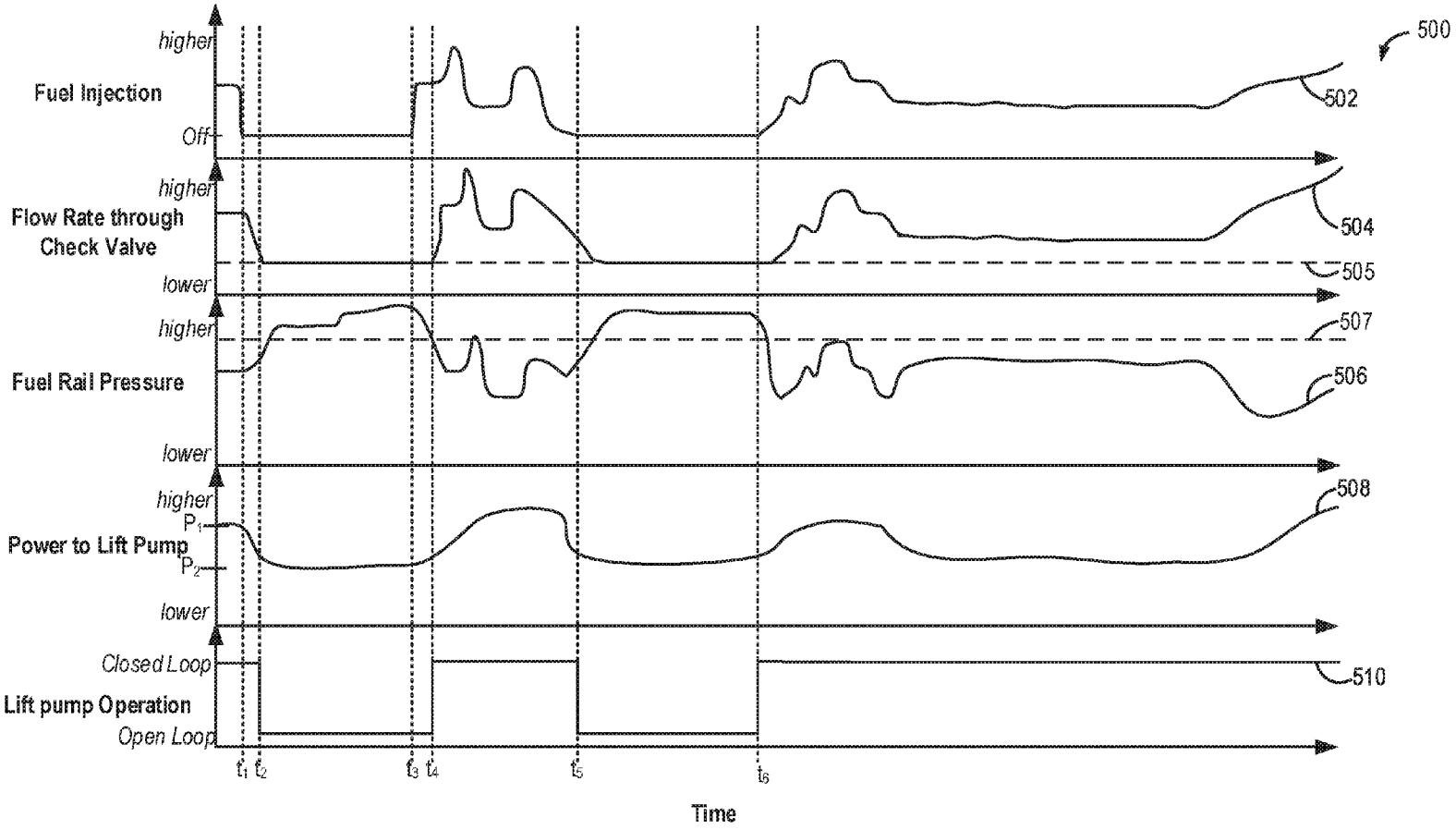
FIG. 5 shows a first graph depicting example fuel lift pump operation under varying engine operating conditions.

Turning now to FIG. 4, it shows a flow chart of an example method 400 for adjusting operation of lift pump (e.g., lift pump 212 shown in FIG. 2) of an engine fuel system (e.g., fuel system 200 shown in FIG. 2). During engine operation an amount of power supplied to the lift pump may be adjusted to achieve a desired fuel pressure in a fuel rail (e.g., fuel rails 250 and 260 shown in FIG. 2). Thus, the lift pump may be closed loop of feedback controlled by an engine controller (e.g., controller 222 shown in FIG. 2) based on outputs from a pressure sensor (e.g., pressure sensors 248 and 258 shown in FIG. 2) positioned in the fuel rail. However, the controller may switch to open loop control of the lift pump in response to a fuel flow through a check valve (e.g., check valve 213 shown in FIG. 2) positioned between the lift pump and the fuel rail decreasing below a threshold.

Instructions for executing method 400 may be stored in the memory of the controller. Therefore method 400 may be executed by the controller based on the instructions stored in the memory of the controller and in conjunction with signals received from sensors of the engine system, such as the sensors described above with reference to FIGS. 1 and 2. The controller may send signals to the lift pump and/or to a power source supplying power to the lift pump, to adjust an amount of power supplied to the lift pump, and therefore an output of the lift pump.

Method 400 begins at 402 which comprises estimating and/or measuring engine operating conditions. Engine operating conditions may include a fuel rail pressure, a current lift pump speed, an engine speed, a throttle position, an engine load, an operator commanded torque, an intake mass airflow, a fuel injection amount or flow rate, etc.

After estimating and/or measuring engine operating conditions at 402, method 400 may continue to 404 which comprises determining a desired fuel rail pressure based on engine operating conditions. For example, as described above with reference to FIG. 3, the desired fuel rail pressure may be determined based on one or more of an estimated fuel volatility, fuel temperature, and engine speed. However, the desired fuel rail pressure may additionally be determined based on the engine load, alternator torque, fuel injection flow rate, lift pump speed, etc. The desired fuel rail pressure may be determined from a look-up table stored in memory of the controller based on one or more of the fuel volatility, fuel temperature, and engine speed.

Method 400 may then proceed to 406 which comprises determining a current fuel flow rate through the check valve. The check valve may be positioned more proximate an outlet of the lift pump than the fuel rail, as depicted for check valve 213 above in FIG. 2. The current fuel flow rate through the check valve may be computed based on a current injection flow rate, a rate of pressure increase in a fuel line coupling the lift pump to the fuel rail (e.g., passage 218 shown in FIG. 2), and a known or estimated fuel density. Specifically, the flow rate may be computed from the equation below:

$$\text{Fuel Mass Flow Rate} = F(i) + \frac{dP}{dt} * k * \rho$$

$$\text{Fuel Volume Flow Rate} = F(i) + \frac{dP}{dt} * k$$

In the above equations, F(i) may represent a volumetric injection flow rate, or a mass flow rate of fuel flowing through one or more injectors (e.g., injectors 252 and 262 shown in FIG. 2) in a PFI fuel system. In a DI fuel system, F(i) may represent the fuel flow rate through a high pressure pump (e.g., HPP 214 shown in FIG. 2). In a PFDI fuel system, F(i) may represent the sum of injection flow rate and HPP flow rate. Thus, F(i) may represent the mass flow rate of fuel exiting one or more fuel rails.

The $$\frac{dP}{dt}$$

term may represent the rate of change of pressure in the fuel line, k represents compliance, and ρ is the fuel density. Fuel line pressure may be obtained by an engine controller (e.g., controller 222 shown in FIG. 2) sampling the fuel line pressure sensor (e.g., pressure sensors 248 and 258 shown in FIG. 2). The rate of change of fuel line pressure may be obtained by differentiating fuel line pressure with respect to time. The engine controller may perform this task by computing the difference in fuel line pressure of successive samples and dividing by the time between samples. However, a more sophisticated processing such as the use of the Savitzky-Golay filter could be used for increased accuracy.

Fuel line compliance may be obtained by observing the change in pressure of the fuel line after a known decrease in fuel line volume. When the lift pump is commanded off (e.g., 0V, 0 W, 0 Nm, etc.), a check valve included between the lift pump and the fuel rail (e.g., check valve 213 shown in FIG. 2) prevents fuel from exiting the fuel line into the fuel tank. Thus, the change in volume of the fuel line may be due solely to F(i), the flow rate of fuel exiting the fuel line. The engine controller may integrate F(i) over a known span of time to obtain a volume. During the same span of time, the engine controller may also calculate the initial and final pressure of the fuel line using the fuel line pressure sensor. The engine controller may use this change in pressure and volume to infer the compliance of the fuel line. It is important to note that this procedure may be executed in steady-state periods of engine operation for consistent, more accurate measurements. For example, the procedure may not be executed during DFSO operation so as to avoid changes in fuel line volume due to heating. Such an effect may be negligible while fuel is being injected into a running engine.

Thus, the flow rate through the check valve may be affected by the pressure difference between the outlet of the lift pump and the fuel rail, and the injection flow rate of fuel exiting the fuel rail. However, in some examples, the flow rate may additionally be adjusted based on a temperature of the fuel. Specifically, the pressure in the fuel rail may change due to changes in the temperature of the fuel included in the fuel rail. The pressure in the fuel rail may increase as the temperature of the fuel increases, since the density of the fuel may decrease and therefore, the volume of the fuel may increase with increasing fuel temperatures. For example the fuel density may decrease 0.095% for each 1° C. of temperature increase. After estimating the current fuel flow rate through the check valve at 406, method 400 may proceed to 408 which comprises determining if the fuel flow rate is less than a threshold flow rate. In some examples, the threshold flow rate may be approximately zero. However, in other examples the threshold flow rate may be greater or less than zero. If the flow rate through the check valve is greater than the threshold flow rate, then method 400 may continue from 408 to 410 which comprises continuing to feedback control the lift pump based on output from the pressure sensor positioned in the fuel rail. In other examples, the method 400 at 408 may additionally or alternatively comprise determining if the fuel injection flow rate is less than a threshold. In some examples the fuel injection flow rate threshold may be zero. However, in other examples, the fuel injection flow rate threshold may be greater than zero. Thus, in some examples, the method 400 at 408 may comprise determining if deceleration fuel shut off (DFSO) conditions exit. If it is determined that DFSO conditions do not exist and fuel is being injected by the fuel injectors, and/or the fuel injection flow rate is greater than a threshold, method 400 may continue from 408 to 410.

At, 410 the controller may continue to compute an error based on the difference between the desired fuel rail pressure and the estimated fuel rail pressure obtained from outputs of the pressure sensor, as described above with reference to FIGS. 2 and 3. Thus, outputs from the pressure sensor may be used to estimate the current fuel rail pressure. Based on the difference between the current fuel rail pressure and the desired fuel rail pressure, the controller may adjust an amount of power supplied to the lift pump to more closely align the actual fuel rail pressure to the desired fuel rail pressure. Specifically, the controller may compute and/or update a proportional term and an integral term based on the error. In some examples, the controller may additionally compute and/or update a derivative term based on the error. The proportional and integral terms, and in some the examples the derivative term may be used to adjust a voltage output by the controller, and thus an amount of power supplied to the lift pump. Generally, the controller may signal for a reduction in lift pump power when the estimated fuel rail pressure exceeds the desired fuel rail pressure in an attempt to reduce fuel rail pressure, and may signal for an increase in lift pump power when the estimated when the desired fuel rail pressure exceeds the estimated fuel rail pressure to increase fuel rail pressure. Method 400 may then return.

However, if at 408 it is determined that one or more of the fuel flow rate through the check valve is less than the threshold, the injection flow rate is less than the injection flow rate threshold, and/or DFSO conditions do exist and fuel is not being injected by the fuel injectors, then method 400 may proceed from 408 to optional step 411 which comprises determining if the fuel rail pressure error is less than zero. When the fuel rail pressure error is less than zero, the current/instantaneous estimated fuel rail pressure obtained from a most recent output from the pressure sensor positioned in the fuel rail, may be greater than the desired fuel rail pressure, therefore signaling for a decrease in fuel rail pressure and/or lift pump power, voltage, current, etc. If the fuel rail pressure error is not less than zero, (e.g., measured fuel rail pressure is not greater than desired) then method 400 may continue from 411 to 410 and continue to feedback control the lift pump based on outputs from the fuel rail pressure sensor. However, if the fuel rail pressure error is less than zero at 411, method 400 may proceed from 411 to 412, which comprises open loop operating the fuel lift pump based on a the desired fuel rail pressure. Thus, in some examples, the controller may only switch to open loop control of the fuel lift pump when the fuel flow rate through the check valve is less than the threshold, and the current fuel rail pressure is greater than desired (e.g., fuel rail pressure error is less than zero).

However, in some examples, method 400 may proceed directly from 408 to 412, and may not execute 411. Thus, in other examples, the controller may switch to open loop operating the lift pump anytime the fuel flow rate through the check valve is less than the threshold at 408. The method 400 at 412 may comprise not adjusting the power supplied to the lift pump based on outputs from the pressure sensor. Said another way, the power supplied to the lift pump may be adjusted based on the desired fuel pressure only, and may not be adjusted based on the estimated pressure in the fuel rail. In some examples, the method at 412 may therefore comprise maintaining the power supplied to the lift pump at an approximately constant level. Thus, lift pump speed may be kept approximately consistent.

More specifically, the method 400 at 412 may include the additional steps of freezing the integral term at 414, and/or clipping the proportional term to non-negative values at 416. Thus, open loop operating the lift pump may comprise freezing and/or not updating the integral term at 416. The integral term therefore, may not be used to adjust lift pump operation. In some examples however, freezing the integral term may comprise not updating the integral term, but using a most recently computed value for the integral term for continued lift pump control. Additionally or alternatively, the method 400 may additionally comprise clipping the proportional term to non-negative values at 416. Thus the method at 416, may comprise preventing the proportional term from decreasing below a threshold (e.g., 0). In some examples, the method at 416 may comprise not updating and/or freezing the proportional term. Thus, the proportional term may not be calculated and or updated during open loop operation of the lift pump and may not be used to adjust lift pump operation.

Method 400 may then continue from 412 to 418 which comprises determining if the fuel flow rate is greater than the threshold in the same or similar manner to that described at 408. If one or more of DFSO conditions still exist, fuel injection flow rate is less than the threshold, and/or flow rate through the check valve is less than the threshold, method 400 may return to 412 and may continue to open loop operate the fuel lift pump. However, if it is determined that one or more of fuel injection has been turned on, the injection flow rate has increased above the threshold, and/or the flow rate through the check valve has increased above the threshold, then method 400 may continue to 420 which comprises resuming closed loop feedback control of the lift pump based on outputs from the pressure sensor positioned in the fuel rail.

Thus, at 420, the controller may resume adjusting an amount of power supplied to the lift pump based on outputs from the pressure sensor. As such, the controller may update the integral and proportional terms, and may allow the proportional term to go negative. More simply, the controller may operate the lift pump in the same or similar closed loop manner described above at 410. In some examples, the method 400 at 420 may include optional step 422 which may comprise closed loop controlling the lift pump to a set point less than the desired pressure for a duration before resuming the same closed loop control described above at 410, and then gradually bringing the set point to the desired pressure.

Thus, when exiting DFSO, or when the flow rate through the check valve increases above the threshold, the controller may compute the error based on a difference between the estimated fuel rail pressure and a fuel rail pressure that is less than the desired fuel rail pressure. In other words, the set point to which the estimated fuel rail pressure is compared may be set to lower than the desired fuel rail pressure when exiting DFSO, and/or when the flow rate through the check valve increases above a threshold. In this way, overshoots in the fuel rail pressure may be reduced. Specifically, when fuel injection is turned back on, fuel rail pressure may decrease significantly. As such, switching directly back to closed loop control may cause overshoots in fuel rail pressure due to attempts by the controller to increase fuel rail pressure to compensate for the drop that occurs when exiting DFSO. Thus, when exiting DFSO, and/or when the flow rate through the check valve increases above the threshold, the controller may closed loop control the lift pump to a set point less than the desired pressure for a first duration, and then may gradually bring the set point to the desired pressure over a second duration. After the second duration, the controller may closed loop control the lift pump to the desired fuel rail pressure. However, it should be appreciated that in other examples, the controller may not execute 422 and may switch to closed loop feedback control of the lift pump to achieve the desired fuel rail pressure when DFSO ends and/or the fuel flow rate through the check valve increases above the threshold. Method 400 may then return.

Turning now to FIG. 5, it shows a graph 500 depicting example operation of a lift pump (e.g., lift pump 212 shown in FIG. 2) under varying engine operating conditions. Power supplied to the lift pump, and therefore lift pump speed, may be adjusted by an engine controller (e.g., controller 222 shown in FIG. 2). When fuel is being injected by one or more fuel injectors (e.g., injectors 252 and 262 shown in FIG. 2) the lift pump may be feedback controlled by the controller based on outputs from a pressure sensor (e.g., pressure sensors 248 and 258 shown in FIG. 2) positioned in a fuel rail. Thus, lift pump operation may be closed loop feedback controlled based on a fuel pressure in a fuel rail (e.g., fuel rails 250 and 260 shown in FIG. 2) inferred from the pressure sensor. However, during DFSO, and/or when flow through a check valve (e.g., check valve 213 shown in FIG. 2) positioned in a fuel line (e.g., passage 218 shown in FIG. 2) between the lift pump and the fuel rail decreases below a threshold, the controller may switch to open loop operating the lift pump.

Graph 500 shows changes in the fuel injection mass flow rate at plot 502. Fuel injection mass flow rate may be determined based on a commanded fuel injection amount from the controller. Changes in the flow rate through the check valve are shown at plot 504. The flow rate through the check valve may be inferred based on one or more of the injection flow rate, a rate of change in pressure in the fuel line, and a temperature of the fuel as described in more detail above with reference to step 408 in FIG. 4. The check valve may be positioned near an outlet of the lift pump, and may restrict and/or prevent flow back towards the lift pump. When the pressure at the outlet of the lift pump is greater than the pressure downstream of the check valve (e.g., at the fuel rail), fuel may flow through the check valve in the direction of the fuel rail. However, when the pressure at the outlet of the lift pump is less than the pressure downstream of the check valve, the check valve may restrict fuel from flowing back through the check valve towards the lift pump. Thus, the check valve may effectively maintain fuel rail pressure, when the pressure in the fuel rail is greater than the pressure at the outlet of the lift pump.

First threshold 505, may represent substantially zero flow through the check valve. Thus, the threshold 505 may represent a condition where the pressure in the fuel rail is approximately the same as the pressure at the outlet of the lift pump. As such, flow through the check valve may not decrease below the threshold, since flow rates below the threshold may represent flow reversing direction and flowing towards the lift pump, which is prevented by the check valve. However, in other examples, the threshold 505 may represent a flow rate through the check valve greater than zero. Fuel rail pressure is shown at plot 506 and may be estimated based on outputs from the pressure sensor. The second threshold 507, represents a fuel rail pressure level that is substantially the same as the pressure at the outlet of the lift pump. Thus, for fuel rail pressures above the threshold, the fuel rail may be at a higher pressure than the outlet of the lift pump. In such situations, the check valve may preventing fuel from flowing back towards the lift pump. Further, for fuel rail pressures below the threshold, the fuel rail may be at a lower pressure than the outlet of the lift pump and fuel may flow from the lift pump towards the fuel rail. It is important to note that the second threshold 507 is dependent on the pressure at the outlet of the lift pump. Thus, although depicted as constant in FIG. 5, the threshold 507 may fluctuate as lift pump speed fluctuates. For example, at greater lift pump speeds, and therefore greater lift pump outlet pressures, the second threshold 507 may be higher than at lower lift pump speeds and/or lift pump outlet pressures. In some examples, as shown below with reference to FIGS. 6 and 7, pressure at the outlet of the lift pump may be estimated based on outputs from a pressure sensor position at the lift pump outlet. Changes in the amount of power supplied to the lift pump are shown at plot 508. Control of the lift pump in either open loop or closed loop control by the controller is shown at plot 510.

Starting before $t_1$, fuel injection may be on (plot 502), and the fuel injectors may be injecting fuel. Fuel may be flowing through the check valve from the lift pump towards the fuel rail (plot 504) to maintain the fuel rail pressure (plot 506) at a desired pressure. However, fuel rail pressure is below the threshold 507. Further, before $t_1$ the operation of the lift pump may be closed loop controlled by the controller based on outputs from the pressure sensor (plot 510). Thus, the lift pump may be provided with enough power to maintain the fuel rail pressure at the desired pressure, which before $t_1$ may be around a higher first level $P_1$ (plot 508).

At $t_1$ fuel injection may be turned off, and the fuel injectors may stop injecting fuel. However, fuel may still flow through the check valve since the pressure at the outlet of the fuel pump may still be greater than the fuel rail pressure. However, the flow rate through the check valve may begin to decrease at $t_1$, and may continue to decrease until the pressure at the fuel rail reaches the lift pump outlet pressure. Due to the closing of the fuel injectors, the fuel rail pressure may begin to increase at $t_1$. Power to the lift pump may be reduced at $t_1$, since the lift pump may continue to be operated closed loop. In response to the increase in fuel rail pressure, closed loop operation of the lift pump may signal for a decrease in power supplied to the lift pump.

Between $t_1$ and $t_2$, fuel injection remains off, the fuel rail pressure continues to increase, and the flow rate through the check valve continues to decrease. As such, power to the lift pump continues to be reduced, as the lift pump continues to be operated in a closed loop, feedback controlled manner by the controller.

At $t_2$, the fuel rail pressure may reach the lift pump outlet pressure, and flow through the check may reach the threshold 505 (e.g., zero). Thus, the fuel rail pressure may reach the threshold 507, and flow through the check valve may substantially stop. In response to the flow through the check valve reaching the threshold 505 at $t_2$, the controller may switch to open loop operating the lift pump. Thus, closed loop control of the lift pump may stop at $t_2$. As such, power to the lift pump may be adjusted based on the desired fuel rail pressure, which may be dependent on the fuel injection rate, engine speed, etc., as explained above with reference to FIGS. 3 and 4.

Between $t_2$ and $t_3$ fuel injection may remain off, fuel may continue to not flow through the check valve, and the lift pump may continue to be operated based on the desired fuel rail pressure. Since fuel injection may remain off between $t_2$ and $t_3$, power to the lift pump may continue to be held approximately constant at lower second level $P_2$. Due to thermal heating of the fuel in the fuel rail, the fuel rail pressure may continue to increase between $t_2$ and $t_3$.

At $t_3$, the fuel injectors may be turned back on, the fuel may begin to flow out of the fuel rail. As such, the fuel rail pressure may begin to decrease. However, since the fuel rail pressure may still be higher than the lift pump outlet pressure, fuel may not flow through the check valve, and as such the flow rate through the check valve may remain at the threshold 505. In some examples, the lift pump may continue to be operated open loop by the controller at $t_3$, since the flow rate through the check valve is still at the threshold 505. As such, power to the lift pump may be supplied at around the lower second level $P_2$.

Between $t_3$ and $t_4$, the fuel rail pressure may continue to decrease as fuel injection remains on. However, fuel rail pressure may remain above lift pump outlet pressure, and as such, fuel may not flow through the check valve. As such, the lift pump may continue to be open loop controlled, and power supplied to the lift pump may be adjusted based on the desired fuel rail pressure only, and not based on the estimated fuel rail pressure.

However, at $t_4$, fuel may continue to be injected by the fuel injectors, and the fuel rail pressure may decrease below the pressure at the outlet of the lift pump. As such, fuel may begin flowing through the check valve, and the flow rate through the check valve may increase above the threshold 505. In response to one or more of the pressure at the outlet of the lift pump increasing above the pressure at the fuel rail and/or the flow rate through the check valve increasing above the threshold 505, the controller may switch back to closed loop control of the lift pump at $t_4$. Due to the decreasing fuel rail pressure at $t_4$, closed loop control of the lift pump may signal for an increase in lift pump power to match the fuel rail pressure to the desired fuel rail pressure.

Between $t_4$ and $t_5$, the lift pump may continue to be closed loop controlled, and power to the lift pump may be varied depending on differences between the desired fuel rail pressure and the estimated fuel rail pressure. Fuel injection remains on, and the fuel rail pressure may remain below the threshold 507. As such, fuel may continue to flow through the check valve, and the flow rate through the check valve may continue to fluctuate above the threshold 505.

At $t_5$, fuel injection may be turned off, and thus DFSO conditions may resume at $t_5$, similar at time $t_1$. Although the flow rate through the check valve may remain above the threshold 505 at $t_5$, the controller may switch to open loop control of the lift pump. Thus, in some examples, the controller may switch to open loop control of the lift pump in response to the flow rate through the check valve reaching the threshold 505, as is shown at $t_2$. However, in other examples, the controller may switch to open loop operating the lift pump in response to the fuel injectors being turned off and/or initiation of DFSO. In yet further examples, the controller may switch to open loop operating the lift pump in response to whichever occurs first: either the fuel injectors being turned off, or the flow through the check valve reaching the threshold 505. The fuel rail pressure may begin to increase at $t_5$ since the fuel injectors are off. Further, power to the lift pump may be reduced to approximately earlier levels around $P_2$ due to the open loop control of the lift pump.

Between $t_5$ and $t_6$ fuel injection may remain off, and the lift pump may continue to be open loop operated by the controller. As such, power to the lift pump may fluctuate around $P_2$ depending on changes in the desired fuel rail pressure. The fuel rail pressure may remain above the threshold 507. The flow rate through the check valve may remain around the threshold 505 due to the fuel rail pressure remaining above the threshold 507.

At $t_6$, fuel injection may resume, and the fuel may exit the fuel rail. In response to exiting DFSO conditions at $t_6$, the controller may resume closed loop operation of the lift pump. As such, power to the lift pump may increase at $t_6$ in response to the drop in fuel rail pressure at $t_6$ resulting from the fuel injectors being turned back on. The fuel rail pressure may being to decrease at $t_6$ but may remain above the threshold 507 and as such fuel flow may remain at the threshold 505.

However, after $t_6$, the fuel rail pressure may decrease below the threshold 507, and flow rate through the check valve may increase above the threshold 505. Fuel injection remains on, and power to the lift pump may continue to be adjusted based on outputs from the pressure sensor, in a closed loop manner.

Moving on to FIG. 6, it shows an example fuel system 600 that may be the same or similar to fuel system 200 of FIG. 2, except that fuel system 600 may include an additional pressure sensor at an outlet of the lift pump. Thus, fuel system 600 may include the same components as fuel system 200 shown in FIG. 2 and may be numbered similarly in FIG. 6. As such, components of the fuel system 600 already described in FIG. 2, may not be reintroduced or described again in the description of FIG. 6 herein.

As described above, fuel system 600 may be the same as fuel system 200. However, fuel system 600 may include a pressure sensor 631 between the lift pump 212 and check valve 213. Thus, the pressure sensor 631 may be configured to measure a pressure of the fuel included between the lift pump 212 and the check valve 213. Said another way, outputs from the pressure sensor 631 may be used to estimate a pressure at the outlet 251 of the lift pump 212. The controller 222 may under certain engine operating conditions, adjust an amount of power supplied to the lift pump 212 based on outputs from the pressure sensor 631 as described below with reference to FIG. 6. Thus, the controller 222 may switch between adjusting the power supplied to the lift pump 212 based on outputs from the pressure sensor 631, and based on outputs from one or more of the fuel rail pressure sensor 248 and 258. However, in other examples, the controller 222 may switch between adjusting the power supplied to the lift pump 212 based on outputs from both the pressure sensor 631 and one or more of the fuel rail pressure sensors 248 and 258, and based only on outputs from one or more of the fuel rail pressure sensors 248 and 258.

Figure 7:
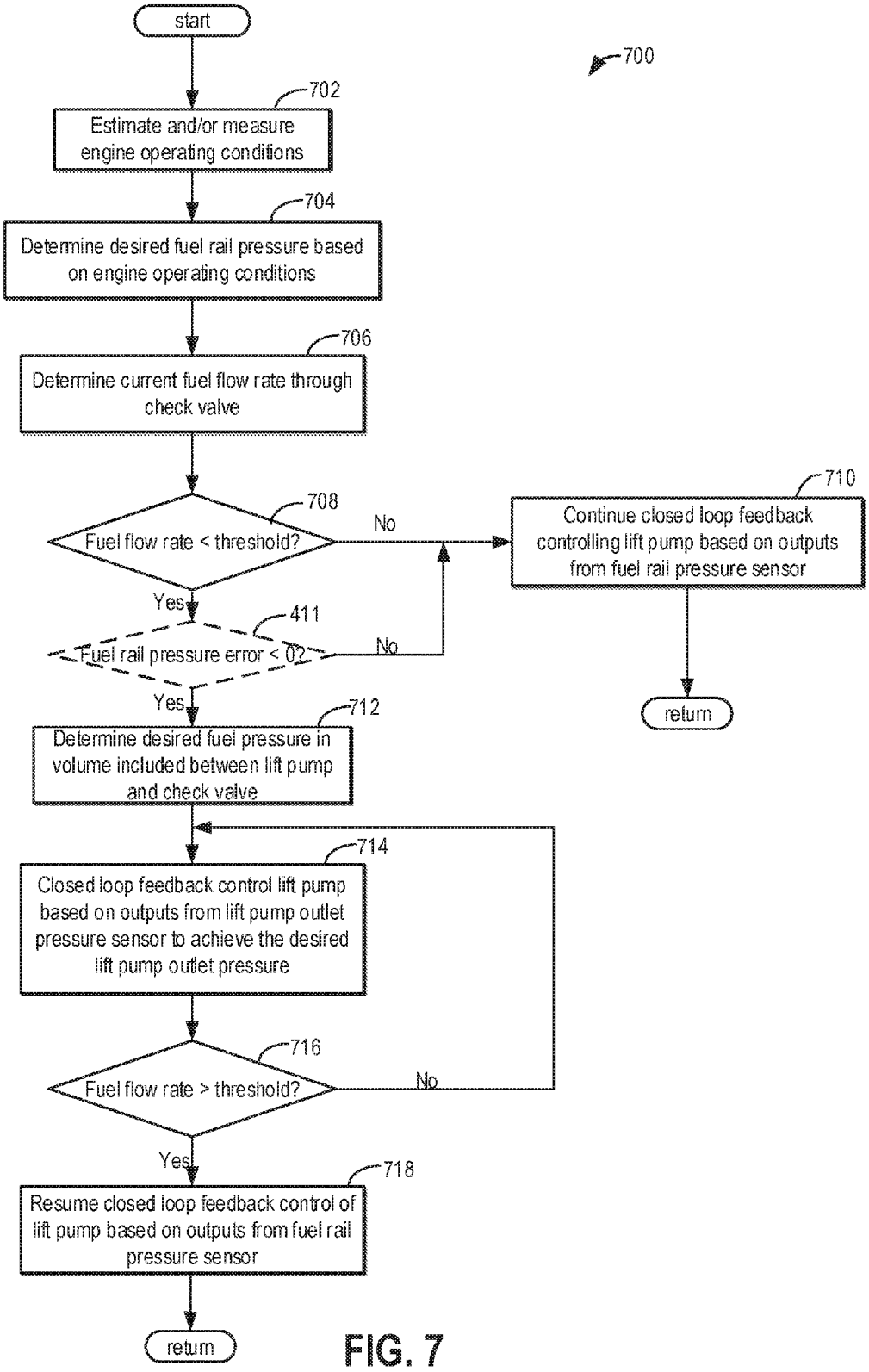
FIG. 7 shows a flow chart of a second example routine for operating a fuel lift pump of the fuel system of FIG. 6.

Turning now to FIG. 7, it shows a flow chart of an example method 700 for operating a lift pump (e.g., lift pump 212 shown in FIGS. 2 and 6) of an engine fuel system (e.g., fuel system 200 shown in FIG. 2) that includes a pressure sensor (e.g., pressure sensor 631 shown in FIG. 6) on or proximate the lift pump outlet, and upstream of any check valve (e.g., check valve 213 shown in FIGS. 2 and 6). The method 700 shown in FIG. 7 describes a system where at low fuel flow rates (e.g., injection flow rates), outputs from the pressure sensor positioned at the outlet of the lift pump may be used to feedback control operation of the lift pump. Further, during higher flow rates, lift pump operation may be feedback controlled based on outputs from a pressure sensor (e.g., pressure sensor 248 shown in FIGS. 2 and 6) positioned in a fuel rail (e.g., fuel rails 250 and 260 shown in FIGS. 2 and 6).

Method 700 may be therefore be the same or similar to method 400 described above with reference to FIG. 4, except that instead of open loop operating the lift pump when fuel flow rates decrease below a threshold, as described at 412 in FIG. 4, method 700 may comprise closed loop operating the lift pump based on outputs from the lift pump outlet pressure sensor (e.g., pressure sensor 631 shown in FIG. 6). Thus, during higher injection fuel flow rates, an amount of power supplied to the lift pump may be adjusted to achieve a desired fuel pressure in a fuel rail (e.g., fuel rails 250 and 260 shown in FIG. 2). The lift pump may therefore be closed loop feedback controlled by an engine controller (e.g., controller 222 shown in FIGS. 2 and 6) based on outputs from one or more fuel rail pressure sensors (e.g., pressure sensors 248 and 258 shown in FIGS. 2 and 6) positioned in the fuel rail. However, the controller may switch to closed loop control of the lift pump based on outputs from the lift pump outlet pressure in response to a fuel flow through a check valve (e.g., check valve 213 shown in FIGS. 2 and 6) positioned between the lift pump and the fuel rail decreasing below a threshold.

Instructions for executing method 700 may be stored in the memory of the controller. Therefore method 700 may be executed by the controller based on the instructions stored in the memory of the controller and in conjunction with signals received from sensors of the engine system, such as the sensors described above with reference to FIGS. 1-2 and 6. The controller may send signals to the lift pump and/or to a power source supplying power to the lift pump, to adjust an amount of power supplied to the lift pump, and therefore an output of the lift pump.

Method 700 begins at 702 which comprises estimating and/or measuring engine operating conditions in the same or similar manner to that described above with reference to 402 in FIG. 4.

After estimating and/or measuring engine operating conditions at 702, method 700 may continue to 704 which comprises determining a desired fuel rail pressure based on engine operating conditions in the same or similar manner to that described above with reference to 404 in FIG. 4.

Method 700 may then proceed to 706 which comprises determining a current fuel flow rate through the check valve in the same or similar manner to that described above with reference to 406 in FIG. 4.

After estimating the current fuel flow rate through the check valve at 706, method 700 may proceed to 708 which comprises determining if the fuel flow rate is less than a threshold flow rate in the same or similar manner to that described above with reference to 408 in FIG. 4.

If one or more of the flow rate through the check valve is greater than the threshold flow rate, and/or it is determined that DFSO conditions do not exist and fuel is being injected by the fuel injectors, and/or the fuel injection flow rate is greater than a threshold, method 700 may continue from 708 to 710.

At, 710 the controller may continue to compute an error based on the difference between the desired fuel rail pressure and the estimated fuel rail pressure obtained from outputs of the fuel rail pressure sensor, in the same or similar manner described above with reference to 410 in FIG. 4.

However, if at 708 it is determined that one or more of the fuel flow rate through the check valve is less than the threshold, the injection flow rate is less than the injection flow rate threshold, and/or DFSO conditions do exist and fuel is not being injected by the fuel injectors, then method 700 may proceed from 708 to 711 which comprises determining if the fuel rail pressure error is less than zero, in the same or similar manner described above with reference to 411 in FIG. 4. If the fuel rail pressure is greater than desired and the fuel rail pressure error is therefore less than zero, method 700 may continue from 708 to 712, where the method 700 at 712 comprises determining a desired fuel pressure in a volume included between the lift pump and the check valve. Thus, in some examples, method 700 may only proceed to 712 if the fuel flow rate through the check valve is less than threshold, and the fuel rail pressure error is less than zero. However, in other examples, method 700 may not execute 711 and may proceed directly from 708 to 712 if the fuel flow rate through the check valve is less than the threshold.

The method 700 at 712 may comprise determining a desired lift pump outlet pressure. In some examples, the desired lift pump outlet pressure may be a pre-set or threshold amount lower than the desired fuel rail pressure determined at 704 and/or the fuel rail pressure measured via outputs from the fuel rail pressure sensor. The desired lift pump outlet pressure may in some examples be 5 kPA below the desired fuel rail pressure and/or estimated fuel rail pressure. However, in other examples, the desired lift pump outlet pressure may be determined based on engine operating conditions, such as a fuel injection amount, a flow rate through one or more check valves positioned between the lift pump and the fuel rail, a fuel rail pressure, a desired fuel rail pressure, etc. For example, when the fuel injectors are turned on, and fuel is flowing out of the fuel rail at higher rates, the desired lift pump outlet pressure may be greater than the desired pressure at the fuel rail. Specifically, the desired lift pump outlet pressure may be 20 kPa greater than the desired fuel rail pressure, to facilitate the flow of fuel from the lift pump to the fuel rail. However, when fuel injection flow rates are lower, and/or when fuel injection is off, and the fuel rail pressure exceeds the desired fuel rail pressure, the desired lift pump outlet pressure may be slightly less than the fuel rail pressure (e.g., 1-10 kPa less than fuel rail pressure) to reduce and/or prevent any pressure being added to the fuel rail.

Thus, the lift pump outlet pressure may be kept just below the fuel rail pressure when fuel flow through the check valve is less than the threshold at 708, and/or the fuel rail pressure is greater than desired, so that substantially no additional fuel flows from the lift pump to the fuel rail. In this way, substantially no additional pressure may be added to the fuel rail by the lift pump, while the speed of the lift pump may be increased relative to what it would be under feedback control from the fuel rail pressure sensor. Thus, the lift pump may remain on, and the speed of the pump remain sufficiently high enough to maintain the lift pump outlet pressure approximately at, or just below the fuel rail pressure when fuel flow rate through the check valve is less than the threshold and fuel rail pressure is greater than desired.

After determining the desired lift pump outlet pressure at 712, method 700 may continue from 712 to 714 which comprises closed loop feedback controlling the lift pump based on outputs from the lift pump outlet pressure sensor to achieve the desired lift pump outlet pressure. In some examples, such as where the desired lift pump outlet pressure is determined based on the desired fuel rail pressure, and is not dependent on the estimated fuel rail pressure obtained from the fuel rail pressure sensor, the method 700 at 714 may comprise not adjusting the lift pump operation based on the fuel rail pressure sensor. That is, the method 700 at 714 may comprise closed loop operating the lift pump based only on outputs from the lift pump outlet pressure sensor and not based on outputs from the fuel rail pressure sensor, to maintain the lift pump outlet pressure at the desired lift pump outlet pressure. Thus, power supplied to the lift pump may be adjusted to maintain the fuel pressure of fuel included between the lift pump and the check valve to a threshold difference of the desired fuel rail pressure.

However, in other examples, such as where the desired lift pump outlet pressure is determined based on the estimated fuel rail pressure, the method 700 at 714 may comprise adjusting the lift pump operation based on both the fuel rail pressure sensor and the lift pump outlet pressure sensor. More specifically, the controller may adjust the amount of power supplied to the lift pump to maintain the fuel pressure of fuel included between the lift pump and the check valve to within a threshold difference of the estimated fuel rail pressure. Based on the difference between the estimated fuel rail pressure obtained from the fuel rail pressure sensor, and the lift pump outlet pressure obtained from the lift pump outlet pressure sensor, the controller may adjust the amount of power supplied to the lift pump to maintain the desired lift pump outlet pressure. Thus, the controller may increase the amount of power supplied to the lift pump in response to the lift pump outlet pressure decreasing below the estimated fuel rail pressure by more than the threshold amount. In other examples, the controller may decrease the amount of power supplied to the lift pump in response to the lift pump outlet pressure increasing such that the difference between the lift pump outlet pressure and the estimated fuel rail pressure is less than the threshold amount.

Method 700 may then continue from 714 to 716 which comprises determining if the fuel flow rate is greater than the threshold in the same or similar manner to that described above with reference to 418 in FIG. 4. If one or more of DFSO conditions still exist, fuel injection flow rate is less than the threshold, and/or flow rate through the check valve is less than the threshold, method 700 may return to 714 and may continue to adjust lift pump operation based on the lift pump outlet pressure sensor. However, if it is determined that one or more of fuel injection has been turned on, the injection flow rate has increased above the threshold, and/or the flow rate through the check valve has increased above the threshold, then method 700 may continue to 718 which comprises resuming closed loop feedback control of the lift pump based on outputs from the fuel rail pressure sensor in the same or similar manner to that described above with reference to 420 in FIG. 4. Method 700 then returns.

It should be appreciated that in other examples at 710 and 718, the lift pump may be closed loop feedback controlled based on outputs from the lift pump outlet pressure sensor (e.g., pressure sensor 631 shown in FIG. 6) and may not be controlled based on outputs from the fuel rail pressure sensor. Thus, in some examples, the lift pump may be closed loop feedback controlled based on the lift pump outlet pressure sensor under all engine operating conditions, and may not be feedback controlled based on outputs from the fuel rail pressure sensor. In such examples, a slow adaptive correction factor for the desired lift pump outlet pressure may be learned based on the difference between outputs from the lift pump outlet pressure sensor and the fuel rail pressure sensor. Thus, the desired lift pump outlet pressure may be corrected over time based on differences between outputs from the lift pump outlet pressure sensor and the fuel rail pressure sensor. In some examples, this correction factor may be highly correlated to fuel flow rate (e.g., injection flow rate).

In this way, a technical effect of reducing the frequency and intensity of pressure drops in a fuel rail may be reduced by open loop operating a lift pump in response to one or more of a fuel flow rate through a check valve coupled between the lift pump and the fuel rail decreasing to a threshold, entering DFSO, and an injection flow rate decreasing below a threshold. Specifically, by open loop operating the lift pump during DFSO, lift pump speed may be maintained at a higher level than it would be under closed loop control during DFSO. As such, lift pump spin-up time when exiting DFSO may be reduced, and pressure drops in the fuel rail may be reduced. Thus, fluctuations in fuel rail pressure may be reduced and fuel rail pressure consistency may be increased.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

closed loop operating a lift pump of a fuel system based on a difference between a desired fuel rail pressure and an estimated fuel rail pressure; and open loop operating the lift pump to the desired fuel rail pressure in response to a fuel flow rate in a direction of a fuel rail through a first check valve positioned within a fuel tank decreasing to a threshold, wherein the first check valve is positioned upstream of a second check valve, wherein the second check valve is positioned downstream of one or more of a direct injection (DI) pump and a pressure relief valve that selectively returns fuel to the fuel tank, and wherein the estimated fuel rail pressure is determined based on outputs from a pressure sensor positioned downstream of the first and second check valves.

2. The method of claim 1, wherein the closed loop operating the lift pump comprises adjusting an amount of power supplied to the lift pump based on one or more of a proportional term, integral term, and derivative term.

3. The method of claim 2, wherein the closed loop operating the lift pump further comprises updating and computing the proportional term and integral term, and where the updating and computing the proportional term and integral term comprises calculating an error based on a current difference between the desired fuel rail pressure and a most recently estimated fuel rail pressure.

4. The method of claim 1, wherein the open loop operating the lift pump comprises adjusting an amount of power supplied to the lift pump based only on the desired fuel rail pressure and not on the difference between the desired fuel rail pressure and the estimated fuel rail pressure.

5. The method of claim 1, wherein the open loop operating the lift pump comprises one or more of not updating an integral term and clipping a proportional term to non-negative values.

6. The method of claim 1, wherein the threshold represents approximately zero fuel flow through the first check valve.

7. The method of claim 1, wherein the fuel system is one or more of direct injection (DI) and port fuel direct injection (PFDI).

8. The method of claim 1, further comprising open loop operating the lift pump to the desired fuel rail pressure in response to a deceleration fuel shut-off (DFSO) event.

9. The method of claim 1, further comprising open loop operating the lift pump to the desired fuel rail pressure in response to a fuel injection amount decreasing below a threshold.

10. The method of claim 1, wherein the closed loop operating the lift pump comprises adjusting an amount of power supplied to the lift pump to match the estimated fuel rail pressure to the desired fuel rail pressure.

11. The method of claim 1, wherein the fuel flow rate through the first check valve is estimated based on one or more of a fuel injection amount, a fuel pressure rate of change, the estimated fuel rail pressure, a fuel pressure at an outlet of the lift pump, a fuel density, and a fuel temperature.

12. A method for an engine comprising:

adjusting an amount of power supplied to a lift pump of a fuel system based on a difference between a desired fuel rail pressure and an estimated fuel rail pressure of a fuel rail; and regulating the amount of power supplied to the lift pump based on a desired lift pump outlet pressure in response to a fuel flow rate in a direction of the fuel rail through a first check valve positioned between the lift pump and the fuel rail decreasing to a threshold, wherein the first check valve is positioned upstream of a second check valve, wherein the second check valve is positioned downstream of a direct injection (DI) pump and a pressure relief valve that selectively returns fuel to a fuel tank, and wherein the estimated fuel rail pressure is determined based on outputs from a first pressure sensor positioned downstream of the first and second check valves.

13. The method of claim 12, wherein the first pressure sensor is positioned in the fuel rail, and where an estimated lift pump outlet pressure is determined based on outputs from a second pressure sensor positioned between the lift pump and the first check valve, proximate an outlet of the lift pump.

14. The method of claim 13, further comprising adjusting the amount of power supplied to the lift pump based on outputs from the first pressure sensor and not the second pressure sensor in response to the fuel flow rate through the first check valve increasing above the threshold.

15. The method of claim 12, wherein the desired lift pump outlet pressure is determined based on the estimated fuel rail pressure, and where the desired lift pump outlet pressure is a threshold amount less than the estimated fuel rail pressure.

16. The method of claim 12, further comprising adjusting the amount of power supplied to the lift pump based only on outputs from the first pressure sensor in response to the fuel flow rate through the first check valve increasing above the threshold.

17. An engine system comprising:

a lift pump;

a direct injection (DI) pump;

a fuel rail including one or more fuel injectors for injecting liquid fuel;

a first check valve positioned between the lift pump and the fuel rail;

a pressure relief valve positioned downstream of the first check valve;

a second check valve positioned downstream of the pressure relief valve;

a pressure sensor coupled to the fuel rail; and a controller including non-transitory memory with instructions for:

switching from closed loop control of the lift pump to open loop control in response to a fuel flow rate through one or more of the check valves decreasing to a threshold; and resuming closed loop control of the lift pump in response to the fuel flow rate through one or more of the check valves increasing above the threshold.

18. The system of claim 17, wherein the controller is a proportional integral derivative (PID) controller, and where closed loop control of the lift pump comprises adjusting an amount of electrical power supplied to the lift pump based on outputs from the pressure sensor, and where open loop control of the lift pump comprises adjusting the amount of electrical power supplied to the lift pump based on a desired fuel rail pressure and not based on outputs from the pressure sensor.

* * * * *